US011694631B2

(12) United States Patent
Youn et al.

(10) Patent No.: US 11,694,631 B2
(45) Date of Patent: Jul. 4, 2023

(54) GATE DRIVING CIRCUIT HAVING A REPAIR CIRCUIT AND DISPLAY DEVICE INCLUDING THE SAME

(71) Applicant: LG Display Co., Ltd., Seoul (KR)

(72) Inventors: Jae Woong Youn, Paju-si (KR); In June Kim, Paju-si (KR); Min Seon Park, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/891,729

(22) Filed: Aug. 19, 2022

(65) Prior Publication Data

US 2023/0074341 A1 Mar. 9, 2023

(30) Foreign Application Priority Data

Sep. 3, 2021 (KR) ..... 10-2021-0117550
Dec. 17, 2021 (KR) ..... 10-2021-0181976

(51) Int. Cl.
*G09G 3/3266* (2016.01)

(52) U.S. Cl.
CPC ... *G09G 3/3266* (2013.01); *G09G 2310/0286* (2013.01); *G09G 2310/0289* (2013.01); *G09G 2310/0297* (2013.01); *G09G 2310/08* (2013.01); *G09G 2330/021* (2013.01); *G09G 2330/08* (2013.01)

(58) Field of Classification Search
CPC ..... G09G 3/3266; G09G 2310/0286; G09G 2310/0289; G09G 2310/0297; G09G 2310/08; G09G 2330/021; G09G 2330/08
See application file for complete search history.

(56) References Cited

U.S. PATENT DOCUMENTS 11,114,000 B2 9/2021 Jung et al.
2020/0035317 A1* 1/2020 Feng ..... G09G 3/3266
2020/0380898 A1 12/2020 Jung et al.
2021/0166648 A1* 6/2021 Xiong ..... G11C 19/28

FOREIGN PATENT DOCUMENTS

KR 10-2005-0105600 A 11/2005
KR 10-2019-0064082 A 6/2019
KR 10-2020-0137817 A 12/2020
KR 10-2207912 1/2021

* cited by examiner

*Primary Examiner* — Chad M Dicke
(74) *Attorney, Agent, or Firm* — Fenwick & West LLP

(57) ABSTRACT

A gate driving circuit and a display device including the same are disclosed. The gate driving circuit includes a plurality of signal transmitters which are cascade-connected via a carry line to which a carry signal is applied from a previous signal transmitter, and a repair line connected to the plurality of signal transmitters, wherein a signal transmitter includes a circuit part to receive the carry signal from the previous signal transmitter, and charge or discharge a first control node and a second control node, an output part to output a gate signal and a carry signal based on potentials of the first control node and the second control node, and a repair block connected to the repair line and to output a repair gate signal replacing the gate signal and a repair carry signal replacing the carry signal when a logic signal is applied from the repair line.

18 Claims, 21 Drawing Sheets

GATE DRIVING CIRCUIT HAVING A REPAIR CIRCUIT AND DISPLAY DEVICE INCLUDING THE SAME

CROSS-REFERENCE TO RELATED APPLICATIONS

This application claims priority to and the benefit of Republic of Korea Patent Application No. 10-2021-0117550, filed on Sep. 3, 2021, and Republic of Korea Patent Application No. 10-2021-0181976, filed on Dec. 17, 2021, each of which is hereby incorporated by reference in its entirety.

BACKGROUND

1. Field of Technology

The present disclosure relates to a gate driving circuit and a display device including the same.

2. Discussion of Related Art

Display devices includes a liquid crystal display (LCD) device, an electroluminescence display device, a field emission display (FED) device, a plasma display panel (PDP), and the like.

Electroluminescent display devices are divided into inorganic light emitting display devices and organic light emitting display devices according to a material of a light emitting layer. An active-matrix type organic light emitting display device reproduces an input image using a self-emissive element which emits light by itself, for example, an organic light emitting diode (hereinafter referred to as an "OLED"). An organic light emitting display device has advantages in that a response speed is fast and luminous efficiency, luminance, and a viewing angle are large.

Some of display devices, for example, a liquid crystal display device or an organic light emitting display device includes a display panel including a plurality of sub-pixels, a driver outputting a driving signal for driving the display panel, a power supply generating power to be supplied to the display panel or the driver, and the like. The driver includes a gate driver that supplies a scan signal or a gate signal to the display panel, and a data driver that supplies a data signal to the display panel.

A gate driving circuit is applied to a display device in the form of a gate in panel (GIP) which is embedded in a display panel together with pixel arrays. The GIP includes a shift register which sequentially outputs gate voltages and the shift register includes a plurality of cascade-connected signal transmitters. The plurality of signal transmitters are cascade-connected such that one signal transmitter provides a signal necessary for driving another signal transmitter.

Accordingly, when a defect occurs in one signal transmitter, this not only affects the driving of the one signal transmitter in which the defect occurs, but also affects the driving of the other signal transmitter, and thus there is a problem in that the driving of the entire GIP is defective due to the one defective signal transmitter.

SUMMARY

As a repair method for improving a defect of such a signal transmitter, there is a method of inserting one dummy signal transmitter for every predetermined number of signal transmitters and allowing a necessary signal to be output to the dummy signal transmitter using a first control node and a second control node of the defective signal transmitter. However, in this method, since the dummy signal transmitter is inserted for every predetermined number of signal transmitters, it is disadvantageous in terms of a bezel size, and a yield is lowered due to a large number of welding points.

The present disclosure is directed to solving all the above-described necessity and problems.

The present disclosure is directed to providing a gate driving circuit capable of minimizing the number of welding points while reducing a bezel size and a display device including the same.

It should be noted that objects of the present disclosure are not limited to the above-described objects, and other objects of the present disclosure will be apparent to those skilled in the art from the following descriptions.

According to an aspect of the present disclosure, there is provided a gate driving circuit including a plurality of signal transmitters which are cascade-connected via a carry line to which a carry signal is applied from a previous signal transmitter, and a repair line connected to the plurality of signal transmitters, wherein an n-th (where n is a positive integer) signal transmitter includes a circuit part configured to receive the carry signal from the previous signal transmitter and charge or discharge a first control node and a second control node, an output part configured to output a gate signal and a carry signal on the basis of potentials of the first control node and the second control node, and a repair block connected to the repair line and configured to output a repair gate signal replacing the gate signal and a repair carry signal replacing the carry signal when a logic signal is applied from the repair line.

BRIEF DESCRIPTION OF THE DRAWINGS

The above and other objects, features, and advantages of the present disclosure will become more apparent to those of ordinary skill in the art by describing exemplary embodiments thereof in detail with reference to the accompanying drawings, in which.

DETAILED DESCRIPTION

Figure 1:
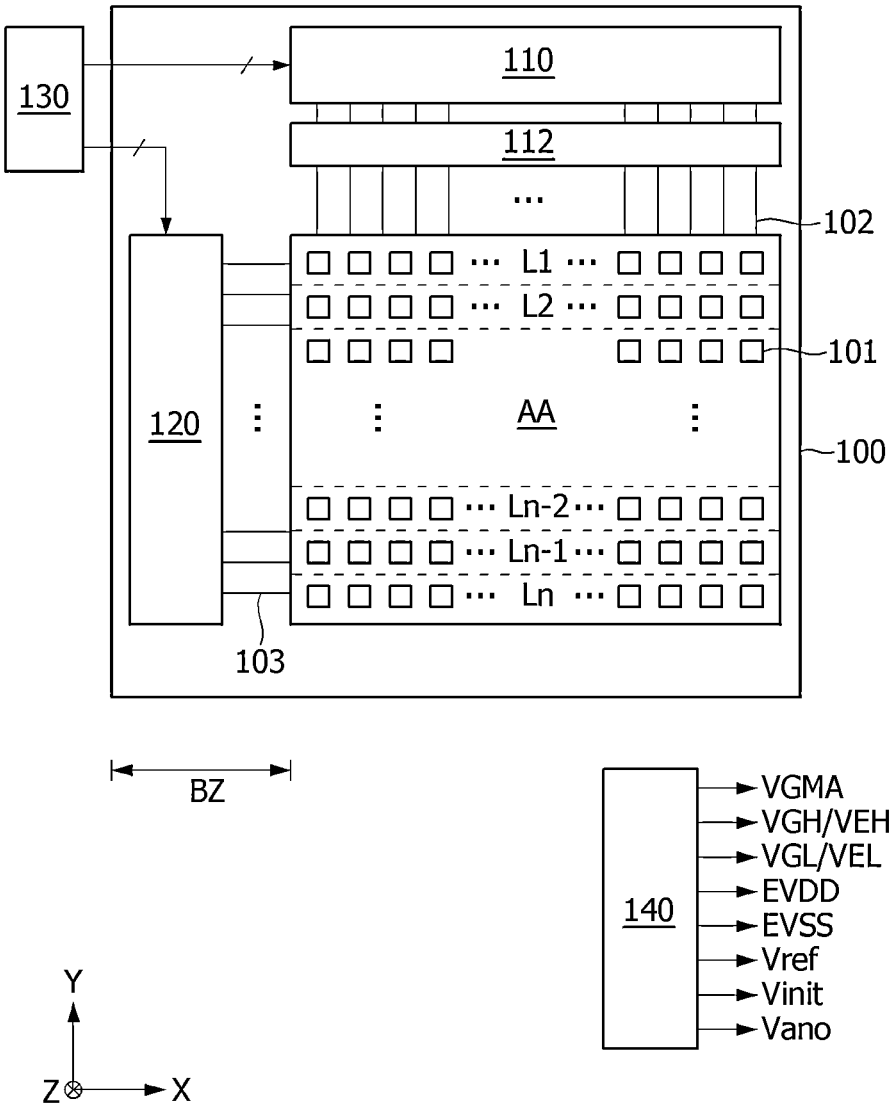
FIG. 1 is a block diagram illustrating a display device according to an embodiment of the present disclosure.

The advantages and features of the present disclosure and methods for accomplishing the same will be more clearly understood from embodiments described below with reference to the accompanying drawings. However, the present disclosure is not limited to the following embodiments but may be implemented in various different forms. Rather, the present embodiments will make the disclosure of the present disclosure complete and allow those skilled in the art to completely comprehend the scope of the present disclosure. The present disclosure is only defined within the scope of the accompanying claims.

The shapes, sizes, ratios, angles, numbers, and the like illustrated in the accompanying drawings for describing the embodiments of the present disclosure are merely examples, and the present disclosure is not limited thereto. Like reference numerals generally denote like elements throughout the present specification. Further, in describing the present disclosure, detailed descriptions of known related technologies may be omitted to avoid unnecessarily obscuring the subject matter of the present disclosure.

The terms such as "comprising," "including," and "having" used herein are generally intended to allow other components to be added unless the terms are used with the term "only." Any references to singular may include plural unless expressly stated otherwise.

Components are interpreted to include an ordinary error range even if not expressly stated.

When the position relation between two components is described using the terms such as "on," "above," "below," and "next," one or more components may be positioned between the two components unless the terms are used with the term "immediately" or "directly."

The terms "first," "second," and the like may be used to distinguish components from each other, but the functions or structures of the components are not limited by ordinal numbers or component names in front of the components.

The same reference numerals may refer to substantially the same elements throughout the present disclosure.

The following embodiments can be partially or entirely bonded to or combined with each other and can be linked and operated in technically various ways. The embodiments can be carried out independently of or in association with each other.

Hereinafter, various embodiments of the present disclosure will be described in detail with reference to the accompanying drawings.

Figure 2:
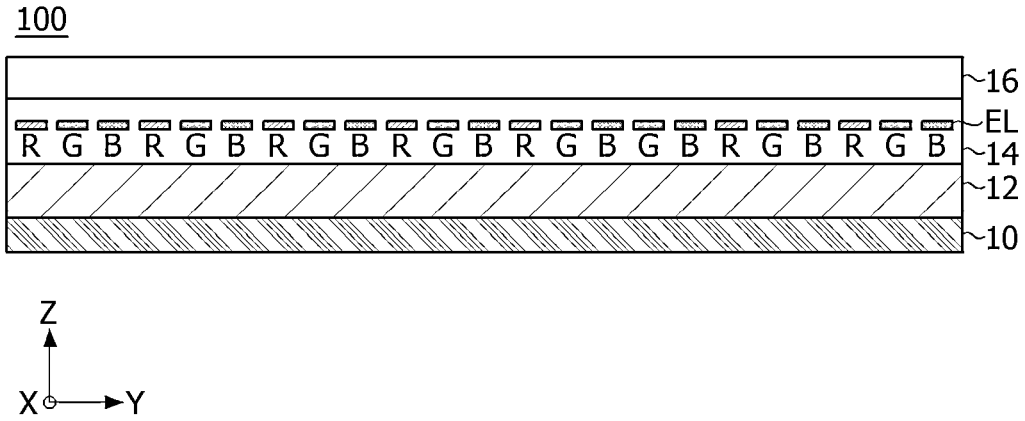
FIG. 2 is a view illustrating a cross-sectional structure of a display panel illustrated in FIG. 1 according to an embodiment of the present disclosure.

FIG. 1 is a block diagram illustrating a display device according to an embodiment of the present disclosure, and FIG. 2 is a diagram illustrating a cross-sectional structure of the display panel shown in FIG. 1 according to an embodiment of the present disclosure.

Referring to FIGS. 1 and 2, the display device according to an embodiment of the present disclosure includes a display panel 100, a display panel driver for writing pixel data to pixels 101 of the display panel 100, and a power supply 140 for generating power necessary for driving the pixels 101 and the display panel driver.

The display panel 100 may be a display panel having a rectangular structure having a length in an X-axis direction, a width in a Y-axis direction, and a thickness in a Z-axis direction. The display panel 100 includes a pixel array AA that displays an input image. The pixel array AA includes a plurality of data lines 102, a plurality of gate lines 103 that intersect with the data lines 102, and pixels 101 arranged in a matrix form. The display panel 100 may further include power lines commonly connected to pixels 101. The power lines may include a power line to which a pixel driving voltage ELVDD is applied, a power line to which an initialization voltage Vinit is applied, a power line to which a reference voltage Vref is applied, and a power line to which a low potential power voltage ELVSS is applied. These power lines are commonly connected to the pixels 101.

The pixel array AA includes a plurality of pixel lines L1 to Ln. Each of the pixel lines L1 to Ln includes one line of pixels 101 arranged along a line direction X in the pixel array AA of the display panel 100. Pixels arranged in one pixel line share a same gate line 103. Sub-pixels arranged in a column direction Y along a data line direction share the same data line 102. One horizontal period 1H is a time obtained by dividing one frame period by the total number of pixel lines L1 to Ln.

The display panel 100 may be implemented as a non-transmissive display panel or a transmissive display panel. The transmissive display panel may be applied to a transparent display device in which an image is displayed on a screen and an actual background may be seen.

The display panel 100 may be implemented as a flexible display panel. The flexible display panel may be made of a plastic OLED panel. An organic thin film may be disposed on a back plate of the plastic OLED panel, and the pixel array AA and light emitting element may be formed on the organic thin film.

To implement color, each of the pixels 101 may be divided into a red sub-pixel (hereinafter referred to as "R sub-pixel"), a green sub-pixel (hereinafter referred to as "G sub-pixel"), and a blue sub-pixel (hereinafter referred to as "B sub-pixel"). Each of the pixels 101 may further include a white sub-pixel. Each of the sub-pixels includes a pixel circuit. The pixel circuit is connected to the data line, the gate line and power line.

The pixels 101 may be arranged as real color pixels and pentile pixels. The pentile pixel may realize a higher resolution than the real color pixel by driving two sub-pixels having different colors as one pixel 101 using a preset pixel rendering algorithm. The pixel rendering algorithm may compensate for insufficient color representation in each pixel with a color of light emitted from an adjacent pixel.

Touch sensors may be disposed on the display panel 100. A touch input may be sensed using separate touch sensors or may be sensed through pixels. The touch sensors may be disposed as an on-cell type or an add-on type on the screen of the display panel or implemented as in-cell type touch sensors embedded in the pixel array AA.

As shown in FIG. 2, when viewed from a cross-sectional structure, the display panel 100 may include a circuit layer 12, a light emitting element layer 14, and an encapsulation layer 16 stacked on a substrate 10.

The circuit layer 12 may include a pixel circuit connected to wirings such as a data line, a gate line, and a power line, a gate driver (GIP) connected to the gate lines, and the like. The wirings and circuit elements of the circuit layer 12 may include a plurality of insulating layers, two or more metal layers separated with the insulating layer therebetween, and an active layer including a semiconductor material.

The light emitting element layer 14 may include a light emitting element EL driven by a pixel circuit. The light emitting element EL may include a red (R) light emitting element, a green (G) light emitting element, and a blue (B) light emitting element. The light emitting element layer 14 may include a white light emitting element and a color filter. The light emitting elements EL of the light emitting element layer 14 may be covered by a protective layer including an organic film and a passivation film.

The light emitting element EL may be implemented as an OLED including an organic compound layer formed between an anode and a cathode. The organic compound layer may include, but is not limited to, a hole injection layer (HIL), a hole transport layer (HTL), a light emitting layer (EML), an electron transport layer (ETL), and an electron injection layer (EIL).

An organic light emitting diode used as the light emitting element may have a tandem structure in which a plurality of light emitting layers are stacked. The organic light emitting diode having the tandem structure may improve the luminance and lifespan of the pixel.

The encapsulation layer 16 covers the light emitting element layer 14 to seal the circuit layer 12 and the light emitting element layer 14. The encapsulation layer 16 may have a multilayered insulating structure in which an organic film and an inorganic film are alternately stacked. The inorganic film blocks or at least reduces the penetration of moisture and oxygen. The organic film planarizes the surface of the inorganic film. When the organic film and the inorganic film are stacked in multiple layers, a movement path of moisture or oxygen becomes longer compared to a single layer, so that penetration of moisture and oxygen affecting the light emitting element layer 14 can be effectively blocked or at least reduced.

A touch sensor layer may be disposed on the encapsulation layer 16. The touch sensor layer may include capacitive type touch sensors that sense a touch input based on a change in capacitance before and after the touch input. The touch sensor layer may include metal wiring patterns and insulating layers forming the capacitance of the touch sensors. The capacitance of the touch sensor may be formed between the metal wiring patterns. A polarizing plate may be disposed on the touch sensor layer. The polarizing plate may improve visibility and contrast ratio by converting the polarization of external light reflected by metal of the touch sensor layer and the circuit layer 12. The polarizing plate may be implemented as a polarizing plate in which a linear polarizing plate and a phase delay film are bonded, or a circular polarizing plate. A cover glass may be adhered to the polarizing plate.

The display panel 100 may further include a touch sensor layer and a color filter layer stacked on the encapsulation layer 16. The color filter layer may include red, green, and blue color filters and a black matrix pattern. The color filter layer may replace the polarizing plate and increase the color purity by absorbing a part of the wavelength of light reflected from the circuit layer and the touch sensor layer. In this embodiment, by applying the color filter layer having a higher light transmittance than the polarizing plate to the display panel, the light transmittance of the display panel 100 can be improved, and the thickness and flexibility of the display panel 100 can be improved. A cover glass may be adhered on the color filter layer.

The power supply 140 generates direct current (DC) power required for driving the pixel array AA and the display panel driver of the display panel 100 by using a DC-DC converter. The DC-DC converter may include a charge pump, a regulator, a buck converter, a boost converter, and the like. The power supply 140 may adjust a DC input voltage from a host system (not shown) and thereby generate DC voltages such as a gamma reference voltage VGMA, gate-on voltages VGH and VEH, gate-off voltages VGL and VEL, a pixel driving voltage ELVDD, a pixel low-potential power supply voltage ELVSS, a reference voltage Vref, an initial voltage Vinit, an anode voltage Vano, and the like. The gamma reference voltage VGMA is supplied to a data driver 110. The gate-on voltages VGH and VEH and the gate-off voltages VGL and VEL are supplied to a gate driver 120. The pixel driving voltage EVDD and the pixel low-potential power supply voltage EVSS, a reference voltage Vref, an initial voltage Vinit, an anode voltage Vano, and the like are commonly supplied to the pixels.

The display panel driver writes pixel data (digital data) of an input image to the pixels of the display panel 100 under the control of a timing controller (TCON) 130.

The display panel driver includes the data driver 110 and the gate driver 120. A display panel driver may further include a demultiplexer array 112 disposed between the data driver 110 and the data lines 102.

The demultiplexer array 112 sequentially supplies data voltages output from channels of the data driver 110 to the data lines 102 using a plurality of demultiplexers (DEMUXs). The demultiplexers may include a plurality of switch elements disposed on the display panel 100. When the demultiplexers are disposed between output terminals of the data driver 110 and the data lines 102, the number of channels of the data driver 110 may be reduced. The demultiplexer array 112 may be omitted.

The display panel driver may further include a touch sensor driver for driving the touch sensors. The touch sensor driver is omitted from FIG. 1. The touch sensor driver may be integrated into one drive integrated circuit (IC). In a mobile device or wearable device, the timing controller 130, the power supply 140, the data driver 110, the touch sensor driver, and the like may be integrated into one drive integrated circuit (IC).

A display panel driver may operate in a low-speed driving mode under the control of a timing controller (TCON) 130. The low-speed driving mode may be set to reduce power consumption of a display device when there is no change in an input image for a preset number of frames in analysis of the input image. In the low-speed driving mode, the power consumption of the display panel driving circuit and a display panel 100 may be reduced by lowering a refresh rate of pixels when a still image is input for a predetermined time or longer. A low-speed driving mode is not limited to a case in which a still image is input. For example, when the display device operates in a standby mode or when a user command or an input image is not input to a display panel driver for a predetermined time or more, the display panel driver may operate in the low-speed driving mode.

The data driver 110 generates a data voltage Vdata by converting pixel data of an input image received from the timing controller 130 with a gamma compensation voltage every frame period by using a digital to analog converter (DAC). The gamma reference voltage VGMA is divided for respective gray scales through a voltage divider circuit. The gamma compensation voltage divided from the gamma reference voltage VGMA is provided to the DAC of the data driver 110. The data voltage Vdata is outputted through the output buffer AMP in each of the channels of the data driver 110.

The gate driver 120 may be implemented as a gate in panel (GIP) circuit formed directly on a circuit layer 12 of the display panel 100 together with the TFT array of the pixel array AA. The gate in panel (GIP) circuit may be disposed on a bezel area BZ that is a non-display area of the display panel 100 or dispersed in the pixel array on which an input image is reproduced. The gate driver 120 sequentially outputs gate signals to the gate lines 103 under the control of the timing controller 130. The gate driver 120 may sequentially supply the gate signals to the gate lines 103 by shifting the gate signals using a shift register. The gate signal may include scan pulses, emission control pulses (hereinafter referred to as "EM pulses"), initial pulses, and sensing pulses.

The shift register of the gate driver 120 outputs a pulse of the gate signal in response to a start pulse and a shift clock from the timing controller 130, and shifts the pulse according to the shift clock timing.

The timing controller 130 receives, from a host system (not shown), digital video data DATA of an input image and a timing signal synchronized therewith. The timing signal includes a vertical synchronization signal Vsync, a horizontal synchronization signal Hsync, a main clock CLK, a data enable signal DE, and the like. Because a vertical period and a horizontal period can be known by counting the data enable signal DE, the vertical synchronization signal Vsync and the horizontal synchronization signal Hsync may be omitted. The data enable signal DE has a cycle of one horizontal period (1H).

A host system may be any one of a television (TV) system, a tablet computer, notebook computer, a navigation system, a personal computer (PC), a home theater system, a mobile device, and a vehicle system. The host system may scale an image signal from a video source according to the resolution of the display panel 100 and transmit the image signal to a timing controller 130 together with the timing signal.

The timing controller 130 multiplies an input frame frequency by i and controls the operation timing of the display panel driving circuit with a frame frequency of the input frame frequency×i (i is a positive integer greater than 0) Hz. The input frame frequency is 60 Hz in the National Television Standards Committee (NTSC) scheme and 50 Hz in the phase-alternating line (PAL) scheme. The timing controller 130 may lower a driving frequency of the display panel driver by lowering a frame frequency to a frequency between 1 Hz and 30 Hz to lower a refresh rate of pixels in the low-speed driving mode.

Based on the timing signals Vsync, Hsync, and DE received from the host system, the timing controller 130 generates a data timing control signal for controlling the operation timing of the data driver 110, a control signal for controlling the operation timing of the de-multiplexer array 112, and a gate timing control signal for controlling the operation timing of the gate driver 120. The timing controller 130 controls an operation timing of the display panel driver to synchronize the data driver 110, the demultiplexer array 112, a touch sensor driver, and a gate driver 120.

The voltage level of the gate timing control signal outputted from the timing controller 130 may be converted into the gate-on voltages VGH and VEH and the gate-off voltages VGL and VEL through a level shifter (not shown) and then supplied to the gate driver 120. That is, the level shifter converts a low level voltage of the gate timing control signal into the gate-off voltages VGL and VEL and converts a high level voltage of the gate timing control signal into the gate-on voltages VGH and VEH. The gate timing signal includes the start pulse and the shift clock.

Due to process variations and device characteristic variations caused in a manufacturing process of the display panel 100, there may be a difference in electrical characteristics of the driving element between the pixels, and this difference may increase as a driving time of the pixels elapses. An internal compensation technology or an external compensation technology may be applied to an organic light-emitting diode display to compensate for the variations in electrical characteristics of a driving element between the pixels. The internal compensation technology samples a threshold voltage of the driving element for each sub-pixel using an internal compensation circuit implemented in each pixel circuit to compensate a gate-source voltage Vgs of the driving element as much as the threshold voltage. The external compensation technology senses in real time a current or voltage of the driving element which changes according to the electrical characteristics of the driving element using an external compensation circuit. The external compensation technology compensates the variation (or change) in the electrical characteristics of the driving element in each pixel in real time by modulating the pixel data (digital data) of the input image as much as the electric characteristic variation (or change) of the driving element sensed for each pixel. The display panel driver may drive the pixels using the external compensation technology and/or the internal compensation technology. A pixel circuit of the present disclosure may be implemented as a pixel circuit to which an internal compensation circuit is applied.

Figure 3A:
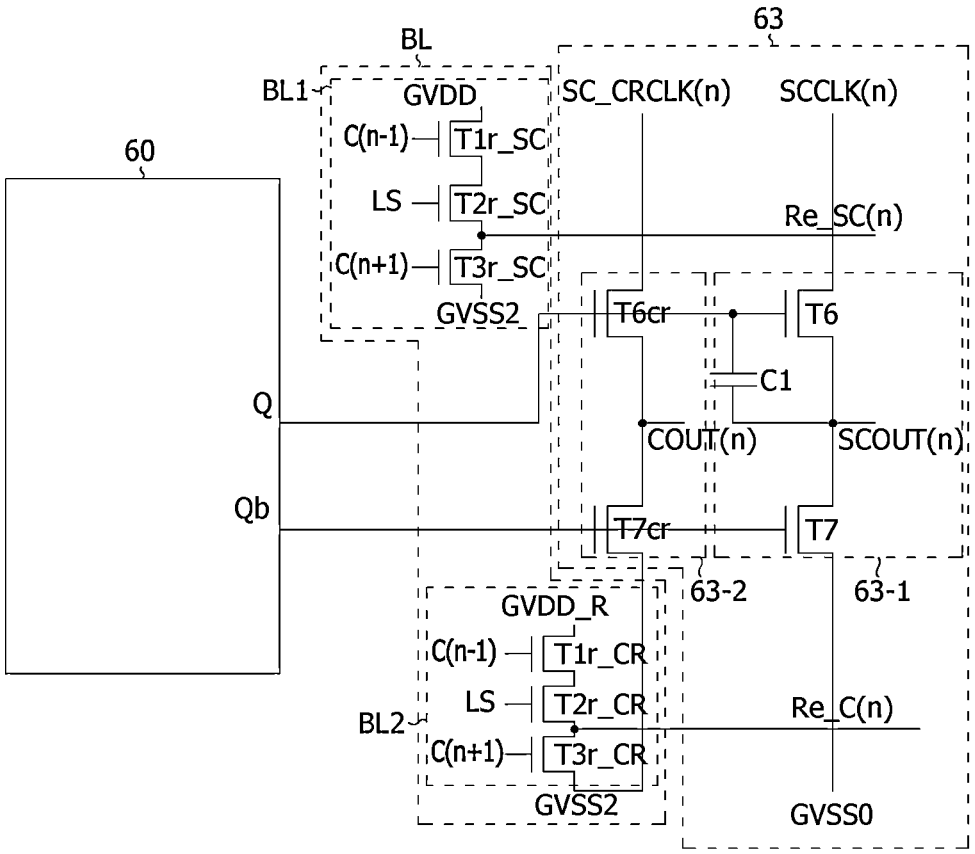
FIGS. 3A and 3B are views illustrating a gate driving circuit according to a first embodiment of the present disclosure.
Figure 3B:
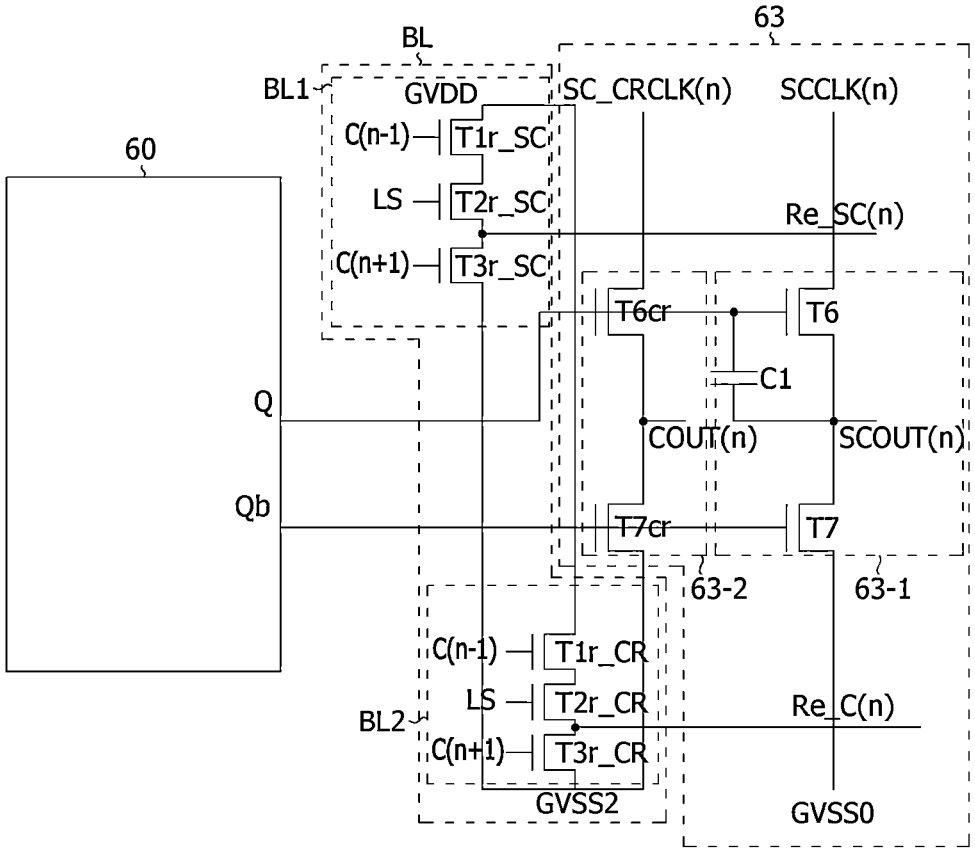

FIGS. 3A and 3B are views illustrating a gate driving circuit according to a first embodiment of the present disclosure.

Referring to FIG. 3A, a scan driving circuit according to the first embodiment may include a first control node (hereinafter, referred to as a "Q node") for pulling up an output voltage, a second control node (hereinafter, referred to as a "Qb node") for pulling down the output voltage, a circuit part 60, an output part 63, and a repair block BL.

The circuit part 60 serves to control charging and discharging of the Q node Q and the Qb node Qb in one embodiment.

The output part 63 may include a first output part 63-1 and a second output part 63-2 in one embodiment.

The first output part 63-1 may output a scan signal SCOUT(n) to a first output node on the basis of potentials of the first control node Q and the second control node Qb. The first output part 63-1 may include a first pull-up transistor T6 and a first pull-down transistor T7 in one embodiment.

The first pull-up transistor T6 and the first pull-down transistor T7 charge and discharge the first output node according to voltages of the first control node and the second control node to output the scan signal SCOUT(n). The first pull-up transistor T6 includes a gate electrode connected to the first control node Q, a first electrode to which a first clock signal is applied, and a second electrode connected to the first output node. The first pull-down transistor T7 is connected to the first pull-up transistor T6 with the first output node therebetween. The first pull-down transistor T7 includes a gate electrode connected to the second control node Qb, a first electrode connected to the first output node, and a second electrode connected to a first low potential voltage line GVSS0.

The second output part 63-2 may output a carry signal COUT(n) to a second output node on the basis of the potentials of the first control node Q and the second control node Qb in one embodiment. The second output part 63-2 may include a second pull-up transistor T6*cr* and a second pull-down transistor T7*cr* in one embodiment.

The second pull-up transistor T6*cr* and the second pull-down transistor T7*cr* charge and discharge the second output node according to the voltages of the first control node and the second control node to output the carry signal COUT(n). The second pull-up transistor T6*cr* includes a gate electrode connected to the first control node Q, a first electrode to which a second clock signal is applied, and a second electrode connected to the second output node. The second pull-down transistor T7*cr* is connected to the second pull-up transistor T6*cr* with the second output node therebetween. The second pull-down transistor T7*cr* includes a gate electrode connected to the second control node Qb, a first electrode connected to the second output node, and a second electrode connected to a second low potential voltage line GVSS2.

The repair block BL may include a first repair block BL1 and a second repair block BL2 in one embodiment. The first repair block BL1 and the second repair block BL2 do not operate when the scan signal and the carry signal are normally output respectively through the first output part 63-1 and the second output part 63-2 and operate when the scan signal and the carry signal are not normally output.

The first repair block BL1 may be a block for repairing the first output part 63-1, and may replace a defective first output part 63-1 to output a repair scan signal Re_SC(n) to a first repair output node in one embodiment. The first repair block BL1 may include a (1-1)th repair transistor T1*r*_SC, a (1-2)th repair transistor T2*r*_SC, and a (1-3)th repair transistor T3*r*_SC in one embodiment. The first repair output node to which the repair scan signal Re_SC(n) is output is connected to the first output node to which the scan signal is output.

The (1-1)th repair transistor T1*r*_SC may be turned on by a carry signal C(n−1) from a previous signal transmitter, and may output a high potential voltage to the first repair output node along with the (1-2)th repair transistor T2*r*_SC. The (1-1)th repair transistor T1*r*_SC includes a first electrode connected to a first high potential voltage line GVDD to which a first high potential voltage is applied, a gate electrode to which the carry signal C(n−1) from the previous signal transmitter is applied, and a second electrode connected to a first electrode of the (1-2)th repair transistor T2*r*_SC.

The (1-2)th repair transistor T2*r*_SC may be turned on by a logic signal LS from a timing controller TCON to output a first high potential voltage to the first repair output node along with the (1-1)th repair transistor T1*r*_SC. The (1-2)th repair transistor T2*r*_SC includes the first electrode connected to the second electrode of the (1-1)th repair transistor T1*r*_SC, a gate electrode to which the logic signal is applied, and a second electrode connected to the first repair output node.

The (1-3)th repair transistor T3*r*_SC may be turned on by a carry signal C(n+1) from a next signal transmitter to output a second low potential voltage to the first repair output node. The (1-3)th repair transistor T3*r*_SC includes a first electrode connected to the first repair output node, a gate electrode to which the carry signal C(n+1) from the next signal transmitter is applied, and a second electrode connected to a second low potential voltage line GVSS2 to which a second low potential voltage is applied.

The second repair block BL2 may be a block for repairing the second output part 63-2, and may replace a defective second output part 63-2 to output a repair carry signal Re_C(n) to a second repair output node in one embodiment. The second repair block BL2 may include a (2-1)th repair transistor T1*r*_CR, a (2-2)th repair transistor T2*r*_CR, and a (2-3)th repair transistor T3*r*_CR in one embodiment. The second repair output node to which the repair carry signal Re_C(n) is output is connected to the second output node to which the carry signal is output.

The (2-1)th repair transistor T1*r*_CR may be turned on by the carry signal C(n−1) from the previous signal transmitter, and may output a high potential voltage to the second repair output node along with the (2-2)th repair transistor T2*r*_CR. The (2-1)th repair transistor T1*r*_CR includes a first electrode connected to a second high potential voltage line GVDD_R to which a second high potential voltage is applied, a gate electrode to which the carry signal C(n−1) from the previous signal transmitter is applied, and a second electrode connected to a first electrode of the (2-2)th repair transistor T2*r*_CR.

The (2-2)th repair transistor T2*r*_CR may be turned on by the logic signal from the timing controller TCON to output the second high potential voltage to the second repair output node along with the (2-1)th repair transistor T1*r*_CR. The (2-2)th repair transistor T2*r*_CR includes the first electrode connected to the second electrode of the (2-1)th repair transistor T1*r*_CR, a gate electrode to which the logic signal is applied, and a second electrode connected to the second repair output node.

The (2-3)th repair transistor T3*r*_CR may be turned on by the carry signal C(n+1) from the next signal transmitter to output the second low potential voltage to the second repair output node. The (2-3)th repair transistor T3*r*_CR includes a first electrode connected to the second repair output node, a gate electrode to which the carry signal C(n+1) from the next signal transmitter is applied, and a second electrode connected to the second low potential voltage line GVSS2 to which the second low potential voltage is applied.

At this point, since voltage levels of the carry signal and the scan signal are different, a case in which power sources are separated is described as an example, but the present disclosure is not necessarily limited thereto, and the power sources may be integrated as shown in FIG. 3B. That is, the first high potential voltage and the second high potential voltage may be the same high potential voltage.

A gate driving circuit of FIG. 3B has the same configuration and function as those of the gate driving circuit in FIG. 3A and is different from the gate driving circuit in FIG. 3A in voltage levels of the high potential voltages of the first repair block BL1 and the second repair block BL2, and thus a detailed description thereof will be omitted.

Figure 4:
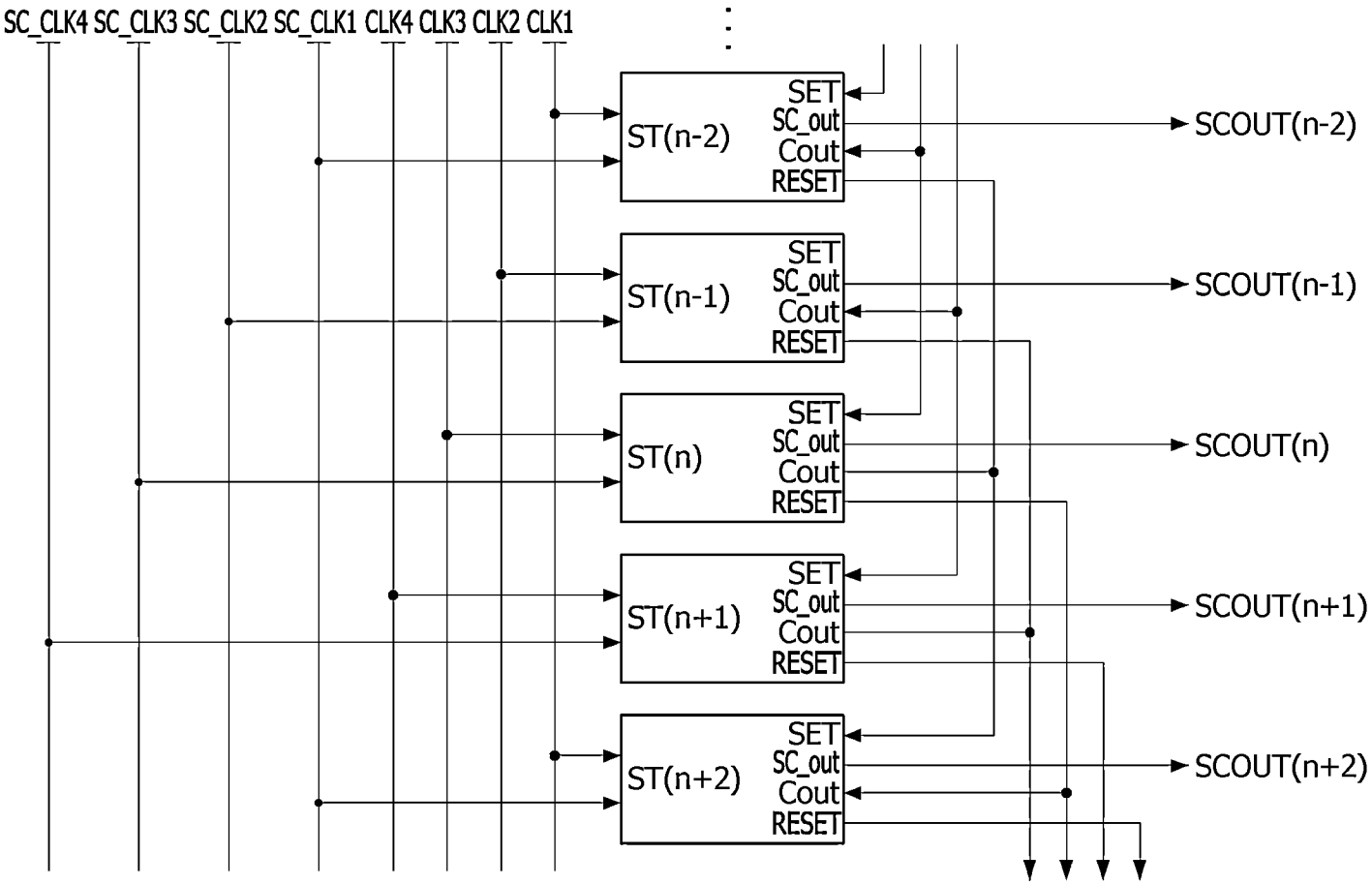
FIG. 4 is a view schematically illustrating a shift register of the gate driving circuit according to the first embodiment of the present disclosure.

FIG. 4 is a view schematically illustrating a shift register of the gate driving circuit according to the first embodiment of the present disclosure.

Referring to FIG. 4, the gate driving circuit according to the first embodiment includes a shift register that sequentially outputs pulses GOUT(n−2) to GOUT(n+2) of a gate signal (hereinafter, referred to as "gate pulses") in synchronization with a shift clock CLK.

The shift register includes a plurality of signal transmitters ST(n−2), ST(n−1), ST(n), ST(n+1), and ST(n+2) which are cascade-connected via a carry line to which the carry signal is transmitted.

The timing controller may adjust a width and a multi-output of an output signal GOUT of the gate driving circuit using a start pulse VST which is input to the gate driving circuit.

The start pulse VST is generally input to a first signal transmitter. In FIG. 4, an (n−2)th signal transmitter ST(n−2) may be the first signal transmitter which receives the start pulse VST.

The signal transmitters ST(n−2), ST(n−1), ST(n), ST(n+1), and ST(n+2) receive the start pulse or respective carry signals COUT(n−2), COUT(n−1), COUT(n), COUT(n+1), and COUT(n+2) each output from the previous signal transmitter, and receive the shift clock CLK. The first transmitter ST(1) starts to be driven according to the start pulse VST, and the other signal transmitters ST(n−2), ST(n−1), ST(n), ST(n+1), and ST(n+2) receive the respective carry signal COUT(n−2), COUT(n−1), COUT(n), COUT(n+1), and COUT(n+2) from the previous signal transmitter and start to be driven. The shift clock CLK may be a clock of N (where N is a positive integer of 2 or more) phases. For example, the shift clock CLK may be four-phase shift clocks CLK1, CLK2, CLK3, and CLK4. A phase difference between the four-phase shift clocks CLK 1, CLK 2, CLK 3, and CLK 4 may be 90°.

The signal transmitters ST(n−2) to ST(n+2) may output scan pulses SCOUT(n−2) to SCOUT(n+2), respectively, through first output nodes thereof, and simultaneously, output the carry signal through second output nodes thereof. Here, a connection relationship between the signal transmitters which are connected based on a four-phase shift clock is illustrated, but the present disclosure is not necessarily limited thereto, and the connection relationship may be changed according to phases.

Figure 5:
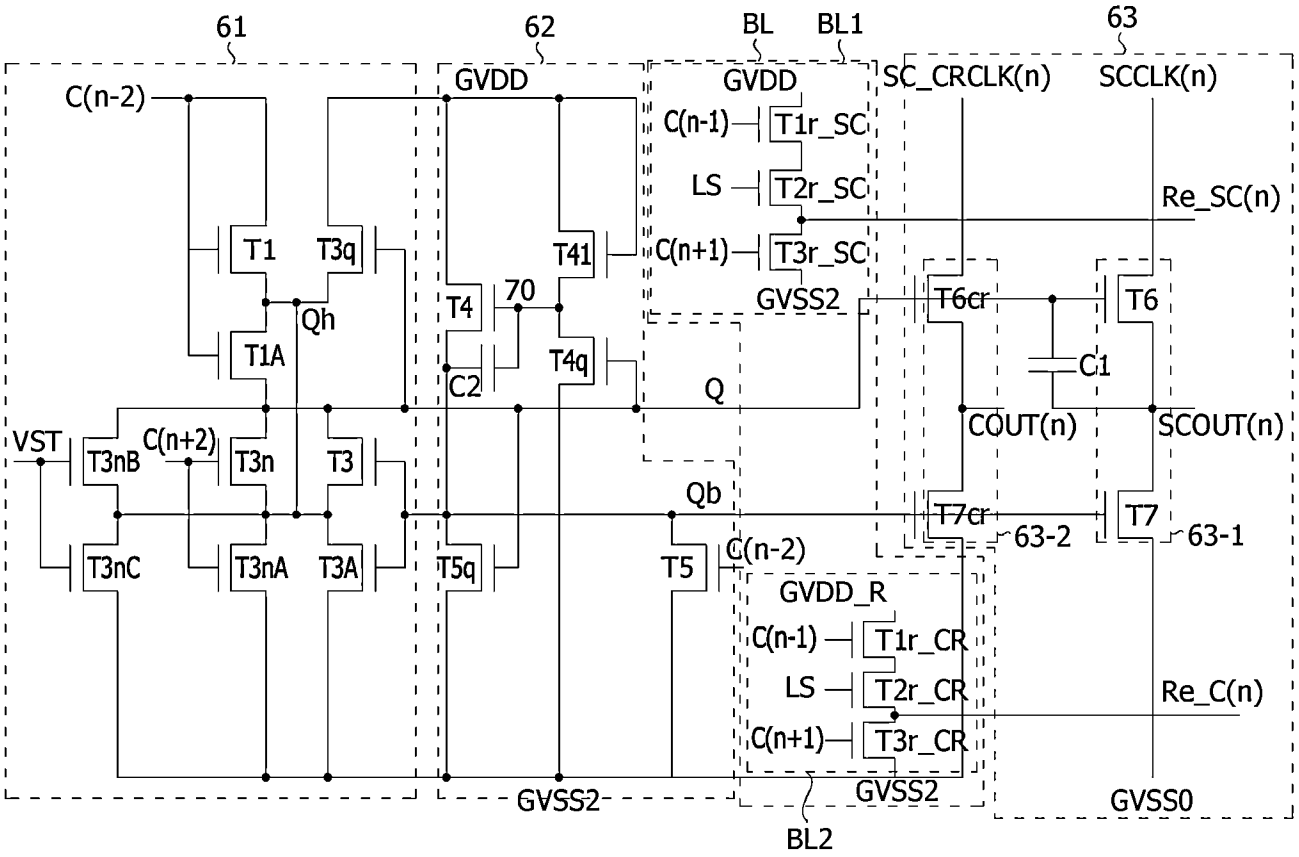
FIG. 5 is a view illustrating a gate driving circuit according to a second embodiment of the present disclosure.
Figure 6:
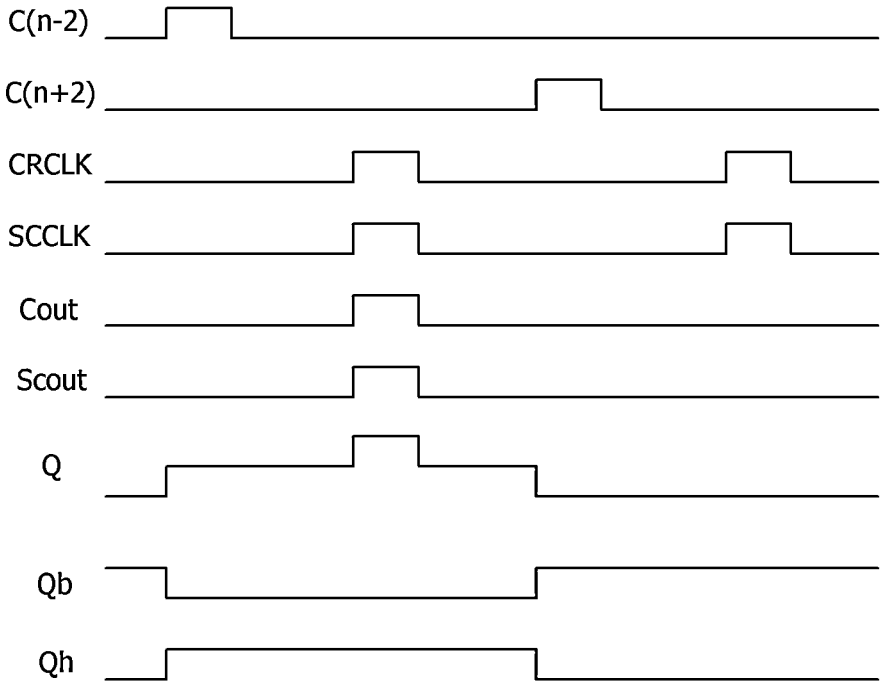
FIG. 6 is a waveform diagram illustrating input/output signals, and voltages of control nodes of the gate driving circuit illustrated in FIG. 5 according to the second embodiment of the present disclosure.

FIG. 5 is a view illustrating a gate driving circuit according to a second embodiment of the present disclosure, and FIG. 6 is a waveform diagram illustrating input/output signals, and voltages of control nodes of the gate driving circuit illustrated in FIG. 5 according to the second embodiment of the present disclosure. Here, an example in which the gate driving circuit is implemented as a scan driving circuit will be described.

Referring to FIGS. 5 and 6, the scan driving circuit according to the second embodiment may include a first control node (hereinafter, referred to as a "Q node") for pulling up an output voltage, a second control node (hereinafter, referred to as a "Qb node") for pulling down the output voltage, a first circuit part 61, a second circuit part 62, an output part 63, and a repair block BL.

The first circuit part 61 serves to control charging and discharging of the Q node Q and the Qb node Qb in one embodiment. The first circuit part 61 includes a first transistor T1, a 1A-th transistor T1A, a third transistor T3, a 3A-th transistor T3A, a 3n-th transistor T3*n*, a 3 nA-th transistor T3*n*A, a 3q-th transistor T3*q*, a 3nB-th transistor T3*n*B, and a 3nC-th transistor T3*n*C in one embodiment.

The first transistor T1 is turned on by an (n−2)th carry signal C(n−2) applied through an (n−2)th carry signal line and transfers the (n−2)th carry signal to a Qh node Qh. The first transistor T1 has a gate electrode and a first electrode commonly connected to the (n−2)th carry signal line, and a second electrode connected to the Qh node Qh.

The 1A-th transistor T1A is turned on by the (n−2)th carry signal C(n−2) applied through the (n−2)th carry signal line and charges the Q node Q on the basis of the (n−2)th carry signal. The 1A-th transistor T1A has a gate electrode connected to the (n−2)th carry signal line, a first electrode connected to the second electrode of the first transistor T1, and a second electrode connected to the Q node Q.

The third transistor T3 is turned on by the voltage of the Qb node Qb and discharges the Q node Q to a second low potential voltage of a second low potential voltage line GVSS2 along with the 3A-th transistor T3A. The third transistor T3 has a gate electrode connected to the Qb node Qb, a first electrode connected to the Q node Q, and a second electrode connected to the first electrode of the 3A-th transistor T3A.

The 3A-th transistor T3A is turned on by the voltage of the Qb node Qb and discharges the Q node Q to the second low potential voltage of the second low potential voltage line GVSS2 along with the third transistor T3. The 3A-th transistor T3A has a gate electrode connected to the Qb node Qb, a first electrode connected to the second electrode of the third transistor T3, and a second electrode connected to the second low potential voltage line GVSS2.

The 3n-th transistor T3*n* is turned on by an (n+2)th carry signal C(n+2) applied through an (n+2)th carry signal line and discharges the Q node Q to the second low potential voltage of the second low potential voltage line GVSS2 along with the 3 nA-th transistor T3*n*A. The 3n-th transistor T3*n* has a gate electrode connected to the (n+2)th carry signal line, a first electrode connected to the Q node Q, and a second electrode connected to a first electrode of the 3 nA-th transistor T3*n*A.

The 3 nA-th transistor T3*n*A is turned on by the (n+2)th carry signal C(n+2) applied through the (n+2)th carry signal line and discharges the Q node Q to the second low potential voltage of the second low potential voltage line GVSS2 along with the 3n-th transistor T3*n*. The 3 nA-th transistor T3*n*A has a gate electrode connected to the (n+2)th carry signal line, the first electrode connected to the second electrode of the 3n-th transistor T3*n*, and a second electrode connected to the second low potential voltage line GVSS2.

The 3q-th transistor T3*q* is turned on by the voltage of the Q node Q and transfers a high potential voltage of a high potential voltage line GVDD to the Qh node Qh. The 3q-th transistor T3*q* has a gate electrode connected to the Q node Q, a first electrode connected to the high potential voltage line GVDD, and a second electrode connected to the Qh node Qh.

The 3nB-th transistor T3*n*B is turned on by the start pulse VST and discharges the first control node Q to a second low potential voltage of a second low potential voltage line GVSS2 along with the 3nC-th transistor T3*n*C. The 3nB-th transistor T3*n*B has a first electrode connected to the first control node Q, a gate electrode to which the start pulse VST is applied, and a second electrode connected to the first electrode of the 3A-th transistor T3A.

The 3nC-th transistor T3*n*C is turned on by the start pulse VST and discharges the first control node Q to a second low potential voltage of a second low potential voltage line GVSS2 along with the 3nB-th transistor T3*n*B. The 3nC-th transistor T3*n*C has a first electrode connected to the second electrode of the 3nB-th transistor T3*n*B, a gate electrode to which the start pulse VST is applied, and a second electrode connected to the second low potential voltage line GVSS2.

The second circuit part 62 includes a fourth transistor T4, a 41-st transistor T41, a 4q-th transistor T4*q*, a fifth transistor T5, and a 5q-th transistor T5*q* in one embodiment.

The fourth transistor T4 is turned on by a voltage of a first node 70 and supplies the high potential voltage to the second control node. The fourth transistor T4 includes a first electrode connected to the high potential voltage line to which the high potential voltage is applied, a gate electrode connected to the first node 70, and a second electrode connected to the second control node. A second capacitor C2 serves to form a bootstrapping voltage at a gate node of the fourth transistor T4.

The 41-st transistor T41 is turned on by the high potential voltage and supplies the high potential voltage to the first node 70. The 41-st transistor T41 includes a first electrode and a gate electrode, which are connected to the high potential voltage line, and a second electrode connected to the first node 70.

The 4q-th transistor T4*q* is turned on by the voltage of the first control node and discharges the first node 70 to the second low potential voltage. The 4q-th transistor T4*q* includes a first electrode connected to the first node 70, a gate electrode connected to the first control node, and a second electrode connected to the second low potential voltage line.

The 5q-th transistor T5*q* is turned on by the voltage of the first control node and discharges the second control node to the second low potential voltage. The 5q-th transistor T5*q* includes a first electrode connected to the second control node, a gate electrode connected to the first control node, and a second electrode connected to the second low potential voltage line GVSS2.

The fifth transistor T5 is turned on by the voltage of a carry signal C(n−2) from a previous signal transmitter and discharges the second control node to the second low potential voltage. The fifth transistor T5 includes a first electrode connected to the second control node, a gate electrode to which the carry signal from the previous signal transmitter is applied, and a second electrode connected to the second low potential voltage line GVSS2.

The output part 63 may include a first output part 63-1 and a second output part 63-2 in one embodiment.

The first output part 63-1 may output a scan signal SCOUT(n) to a first output node on the basis of potentials of the first control node Q and the second control node Qb. The first output part 63-1 may include a first pull-up transistor T6 and a first pull-down transistor T7.

The first pull-up transistor T6 and the first pull-down transistor T7 charge and discharge the first output node according to voltages of the first control node and the second control node to output the scan signal SCOUT(n). The first pull-up transistor T6 includes a gate electrode connected to the first control node Q, a first electrode to which a first clock signal is applied, and a second electrode connected to the first output node. The first pull-down transistor T7 is connected to the first pull-up transistor T6 with the first output node therebetween. The first pull-down transistor T7 includes a gate electrode connected to the second control node Qb, a first electrode connected to the first output node, and a second electrode connected to a first low potential voltage line GVSS0. A first capacitor C1 serves to form a bootstrapping voltage at a gate node of the first pull-up transistor T6.

The second output part 63-2 may output a carry signal COUT(n) to a second output node on the basis of the potentials of the first control node Q and the second control node Qb. The second output part 63-2 may include a second pull-up transistor T6*cr* and a second pull-down transistor T7*cr*.

The second pull-up transistor T6*cr* and the second pull-down transistor T7*cr* charge and discharge the second output node according to the voltages of the first control node and the second control node to output the carry signal COUT(n). The second pull-up transistor T6*cr* includes a gate electrode connected to the first control node Q, a first electrode to which a second clock signal is applied, and a second electrode connected to the second output node. The second pull-down transistor T7*cr* is connected to the second pull-up transistor T6*cr* with the second output node therebetween. The second pull-down transistor T7*cr* includes a gate electrode connected to the second control node Qb, a first electrode connected to the second output node, and a second electrode connected to the second low potential voltage line GVSS2.

The repair block BL may include a first repair block BL1 and a second repair block BL2 in one embodiment.

The first repair block BL1 may be a block for repairing the first output part 63-1, and may replace a defective first output part 63-1 to output a repair scan signal Re_SC(n) to a first repair output node in one embodiment. The first repair block BL1 may include a (1-1)th repair transistor T1*r*_SC, a (1-2)th repair transistor T2*r*_SC, and a (1-3)th repair transistor T3*r*_SC in one embodiment. The first repair output node to which the repair scan signal Re_SC(n) is output is connected to the first output node to which the scan signal is output.

The (1-1)th repair transistor T1*r*_SC may be turned on by a carry signal C(n−1) from the previous signal transmitter, and may output the high potential voltage to the first repair output node along with the (1-2)th repair transistor T2*r*_SC. The (1-1)th repair transistor T1*r*_SC includes a first electrode connected to a first high potential voltage line GVDD to which a first high potential voltage is applied, a gate electrode to which the carry signal C(n−1) from the previous signal transmitter is applied, and a second electrode connected to a first electrode of the (1-2)th repair transistor T2*r*_SC.

The (1-2)th repair transistor T2*r*_SC may be turned on by a logic signal from a timing controller TCON to output the first high potential voltage to the first repair output node along with the (1-1)th repair transistor T1*r*_SC. The (1-2)th repair transistor T2*r*_SC includes the first electrode connected to the second electrode of the (1-1)th repair transistor T1*r*_SC, a gate electrode to which the logic signal is applied, and a second electrode connected to the first repair output node.

The (1-3)th repair transistor T3*r*_SC may be turned on by a carry signal C(n+1) from a next signal transmitter to output the second low potential voltage to the first repair output node. The (1-3)th repair transistor T3*r*_SC includes a first electrode connected to the first repair output node, a gate electrode to which the carry signal C(n+1) from the next signal transmitter is applied, and a second electrode connected to the second low potential voltage line GVSS2 to which the second low potential voltage is applied.

The second repair block BL2 may be a block for repairing the second output part 63-2, and may replace a defective second output part 63-2 to output a repair carry signal Re_C(n) to a second repair output node in one embodiment. The second repair block BL2 may include a (2-1)th repair transistor T1*r*_CR, a (2-2)th repair transistor T2*r*_CR, and a (2-3)th repair transistor T3*r*_CR in one embodiment. The second repair output node to which the repair carry signal Re_C(n) is output is connected to the second output node to which the carry signal is output.

The (2-1)th repair transistor T1*r*_CR may be turned on by the carry signal C(n−1) from the previous signal transmitter, and may output the high potential voltage to the second repair output node along with the (2-2)th repair transistor T2*r*_CR. The (2-1)th repair transistor T1*r*_CR includes a first electrode connected to a second high potential voltage line GVDD_R to which a second high potential voltage is applied, a gate electrode to which the carry signal C(n−1) from the previous signal transmitter is applied, and a second electrode connected to a first electrode of the (2-2)th repair transistor T2*r*_CR.

The (2-2)th repair transistor T2*r*_CR may be turned on by the logic signal from the timing controller TCON to output the second high potential voltage to the second repair output node along with the (2-1)th repair transistor T1*r*_CR. The (2-2)th repair transistor T2*r*_CR includes the first electrode connected to the second electrode of the (2-1)th repair transistor T1*r*_CR, a gate electrode to which the logic signal is applied, and a second electrode connected to the second repair output node.

The (2-3)th repair transistor T3*r*_CR may be turned on by the carry signal C(n+1) from the next signal transmitter to output the second low potential voltage to the second repair output node. The (2-3)th repair transistor T3*r*_CR includes a first electrode connected to the second repair output node, a gate electrode to which the carry signal C(n+1) from the next signal transmitter is applied, and a second electrode connected to the second low potential voltage line GVSS2 to which the second low potential voltage is applied.

Figure 7A:
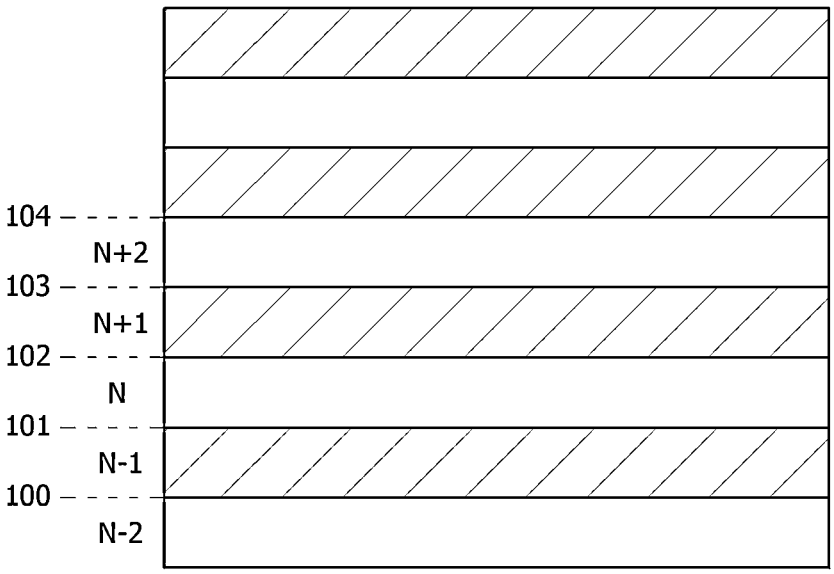
FIGS. 7A and 7B are views for describing a principle of detecting a defective signal transmitter according to one embodiment of the present disclosure.
Figure 7B:
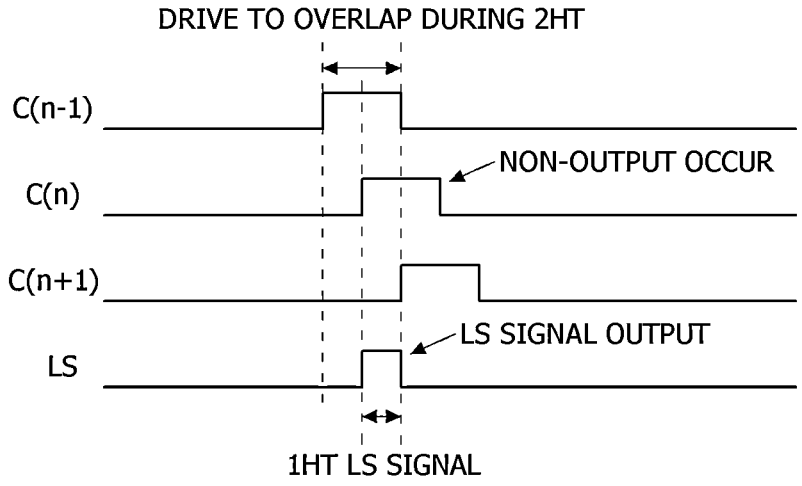

FIGS. 7A and 7B are views for describing a principle of detecting a defective signal transmitter according to one embodiment.

Referring to FIG. 7A, when a defect due to a non-output state is detected in an n-th line, a signal transmitter in which the non-output state occurs may be determined since a number is marked in a gate in panel (GIP) line. That is, a carry signal may not be transferred from a previous signal transmitter, for example, the carry signal may not be transferred from a signal transmitter connected to an (N+2)th line.

Referring to FIG. 7B, in a case in which carry signals are sequentially output from each signal transmitter during two horizontal periods 2HT and overlapped and output during one horizontal period 1HT, when a carry signal C(n) is not output due to a defect in an n-th signal transmitter, a timing controller may output a logic signal to the corresponding signal transmitter in accordance with an output timing of the carry signal C(n).

In this case, the logic signal may be synchronized with the output timing of the signal transmitter in which the carry signal C(n) is not output and may be generated during one horizontal period during which the carry signals do not overlap, but the present disclosure is not necessarily limited thereto.

Figure 8:
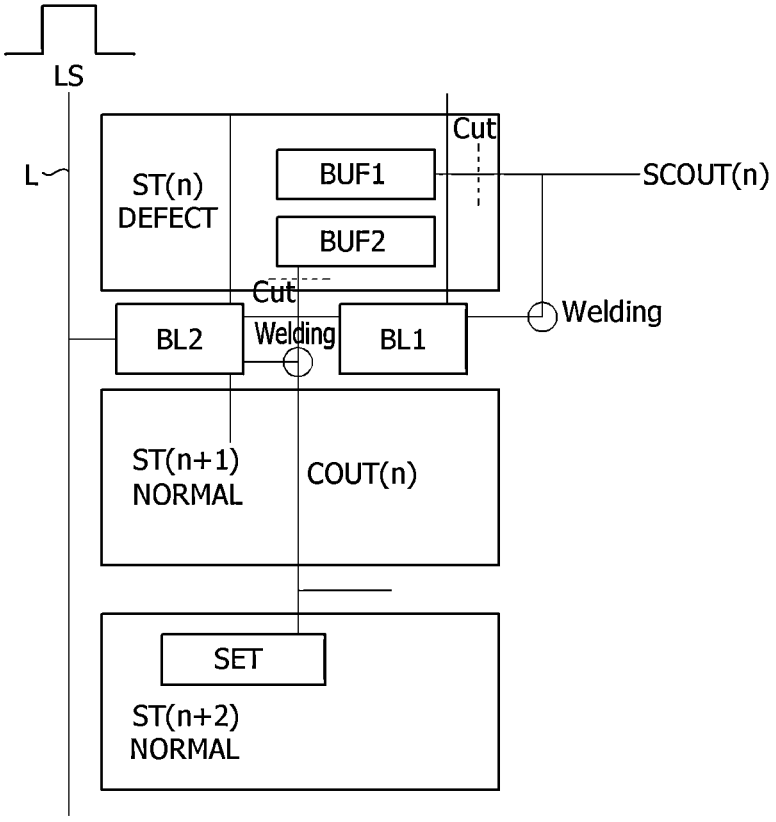
FIG. 8 is a view for describing a principle of repairing the gate driving circuit according to the second embodiment of the present disclosure.
Figure 9A:
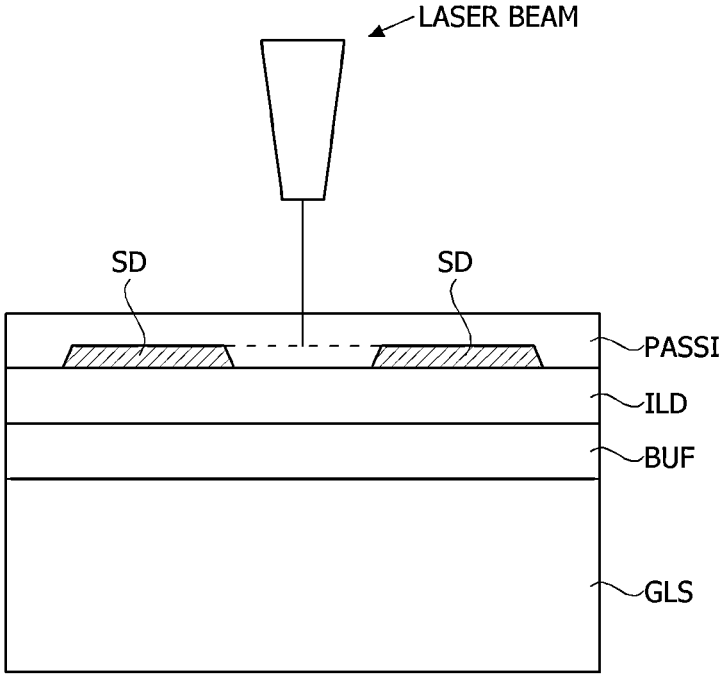
FIGS. 9A to 9C are views for describing a principle of separating and connecting lines illustrated in FIG. 8 according to the second embodiment of the present disclosure.
Figure 9B:
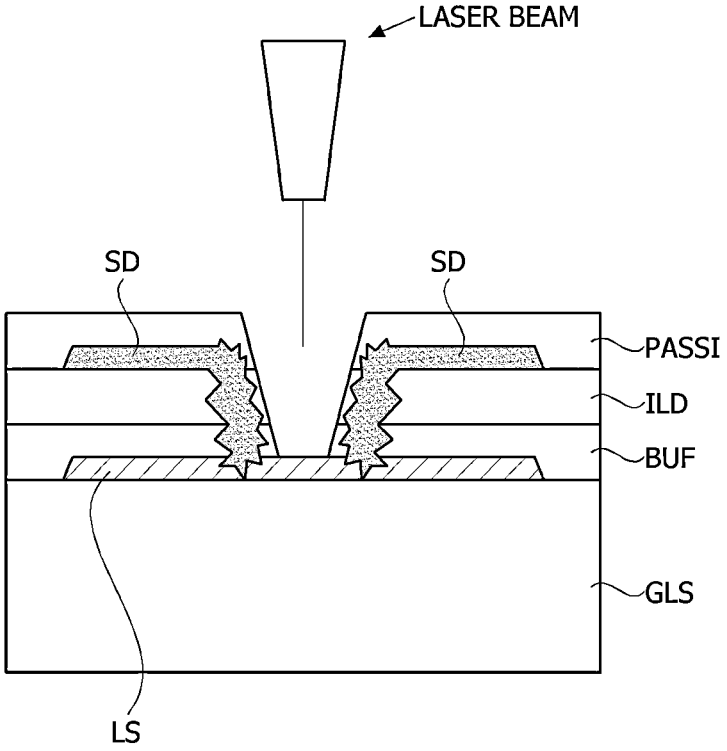
Figure 9C:
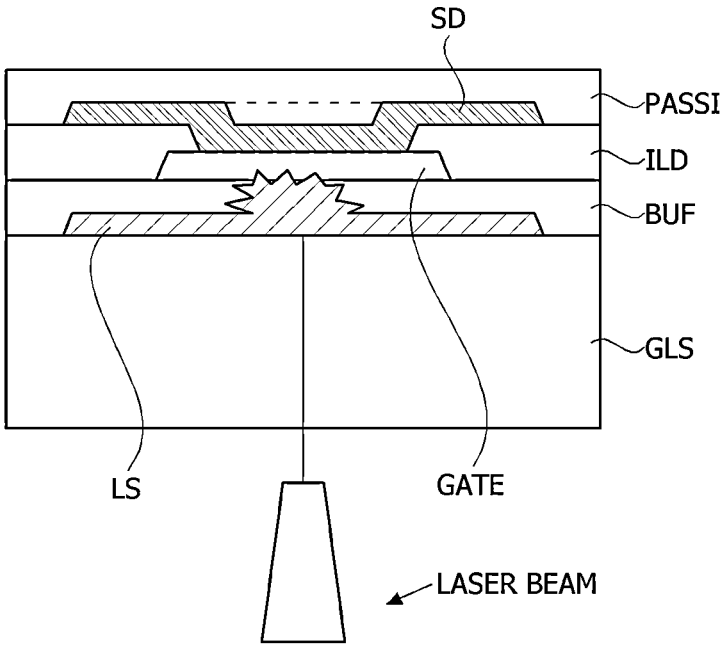

FIG. 8 is a view for describing a principle of repairing the gate driving circuit according to the second embodiment of the present disclosure, and FIGS. 9A to 9C are views for describing a principle of separating and connecting lines illustrated in FIG. 8, and FIGS. 10A to 10C are views for describing an operation timing of the repair block illustrated in FIG. 8.

Referring to FIG. 8, the gate driving circuit according to the second embodiment may include a plurality of signal transmitters ST(n), ST(n+1), and ST(n+2), which are cascade-connected, the first repair block BL1, the second repair block BL2, and a repair line L.

When a defect occurs in the signal transmitter ST(n), a first output node to which the scan signal SCOUT(n) is output may be cut by a laser beam and electrically separated from a first output part BUF1 of the signal transmitter ST(n), and may be welded by the laser beam to be electrically connected to the first repair block BL1.

A second output node to which the carry signal COUT(n) is output may be cut by the laser beam and electrically separated from a second output part BUF2 of the signal transmitter ST(n), and may be welded by the laser beam to be electrically connected to the second repair block BL2.

In the embodiment, when the laser beam is irradiated to perform cutting, a metal pattern SD may be cut by irradiating the laser beam to the metal pattern SD as shown in FIG. 9A. Further, when the laser beam is irradiated to perform welding, the metal pattern SD and an insulating film ILD may be melted and welded to a metal pattern LS, as shown in FIG. 9B. In this case, in order to increase a success rate of welding, the laser beam may be irradiated on a rear surface of a panel as shown in FIG. 9C, and a dissimilar metal may be used to reduce a thickness of the insulating film ILD.

When the logic signal is applied from the timing controller through the repair line L, the first repair block BL1 may output the repair scan signal Re_SC(n) to the first output node.

Figure 10A:
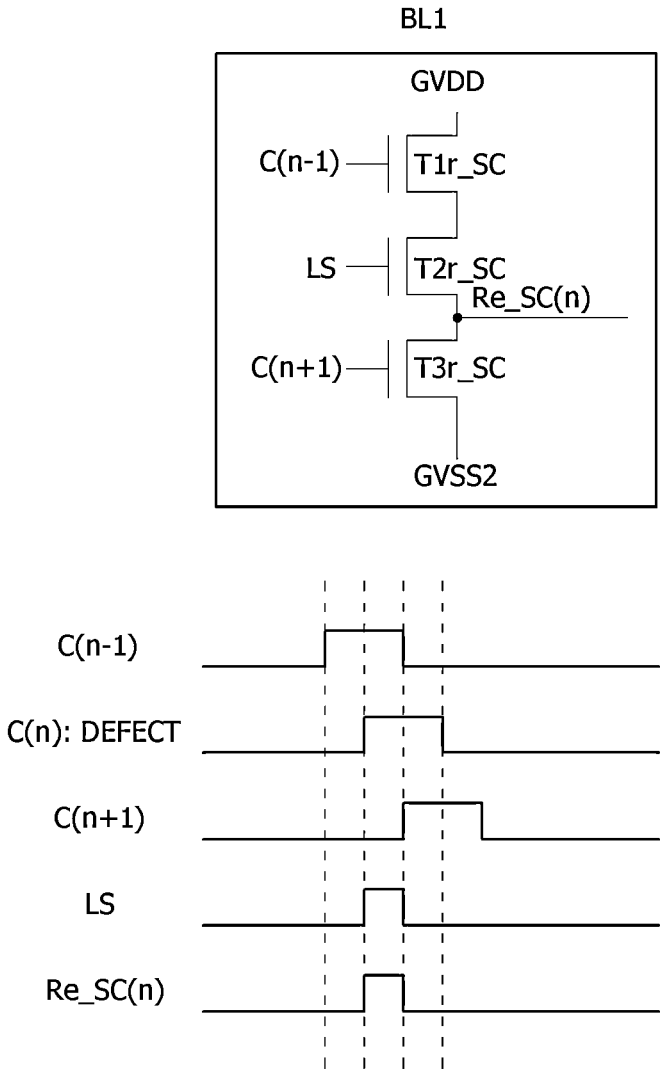
FIGS. 10A to 10C are views for describing an operation timing of a repair block illustrated in FIG. 8 according to the second embodiment of the present disclosure.

Referring to FIGS. 5 and 10A, when the carry signal is not generated from the signal transmitter ST(n) and thus a defect occurs, the logic signal LS and an (n−1)th carry signal C(n−1) may be simultaneously applied to generate the repair scan signal Re_SC(n).

Figure 10B:
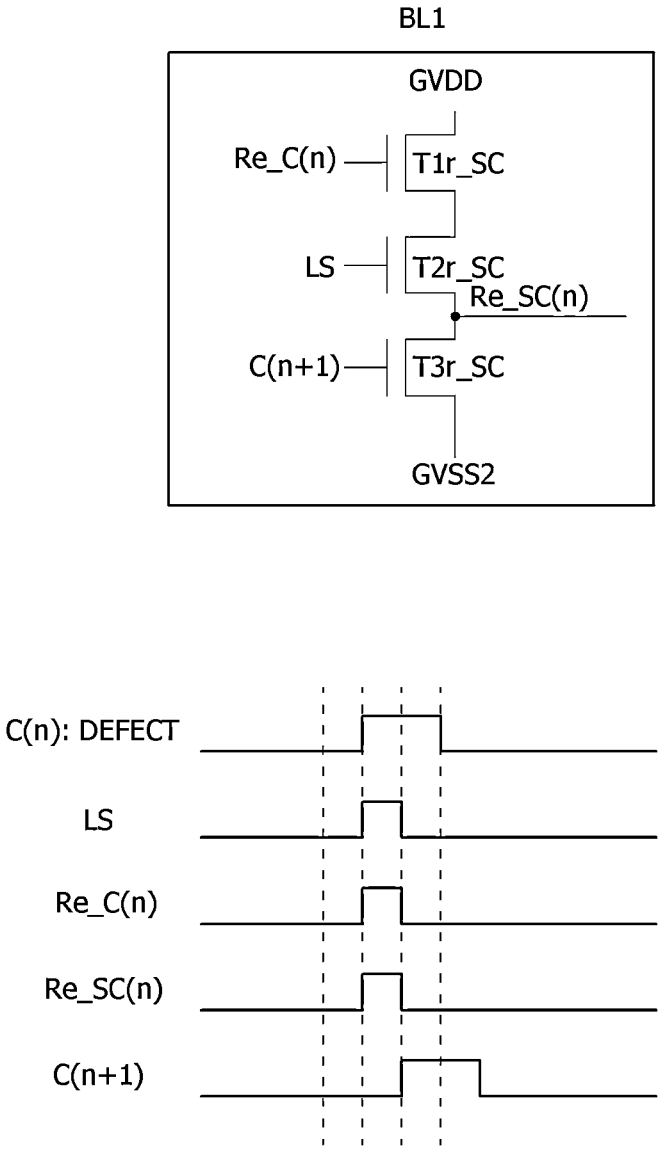

Referring to FIGS. 5 and 10B, when the carry signal is not generated from the signal transmitter ST(n) and thus a defect occurs, the logic signal LS and the repair carry signal Re_C(n) may be simultaneously applied to generate the repair scan signal Re_SC(n). Here, the repair scan signal Re_SC(n) is generated using the repair carry signal Re_C(n) without using the carry signal generated by the previous signal transmitter.

When the logic signal is applied from the timing controller through the repair line L, the second repair block BL2 may output the repair carry signal Re_C(n) to the second output node.

Figure 10C:
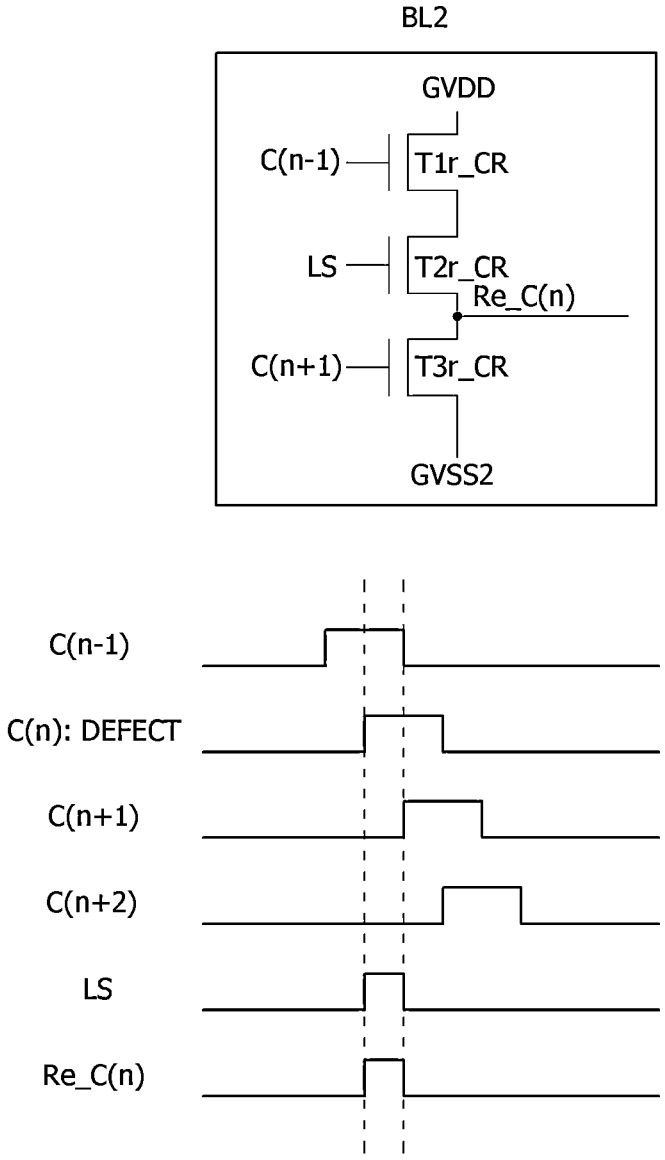

Referring to FIGS. 5 and 10C, when the carry signal is not generated from the signal transmitter ST(n) and thus a defect occurs, the logic signal LS and the (n−1)th carry signal C(n−1) may be simultaneously applied to generate the repair carry signal Re_C(n)

In the embodiment, the logic signal can be repeatedly applied according to the defective signal transmitter, and thus, a plurality of signal transmitters can be repaired without adding a separate repair line.

Figure 11:
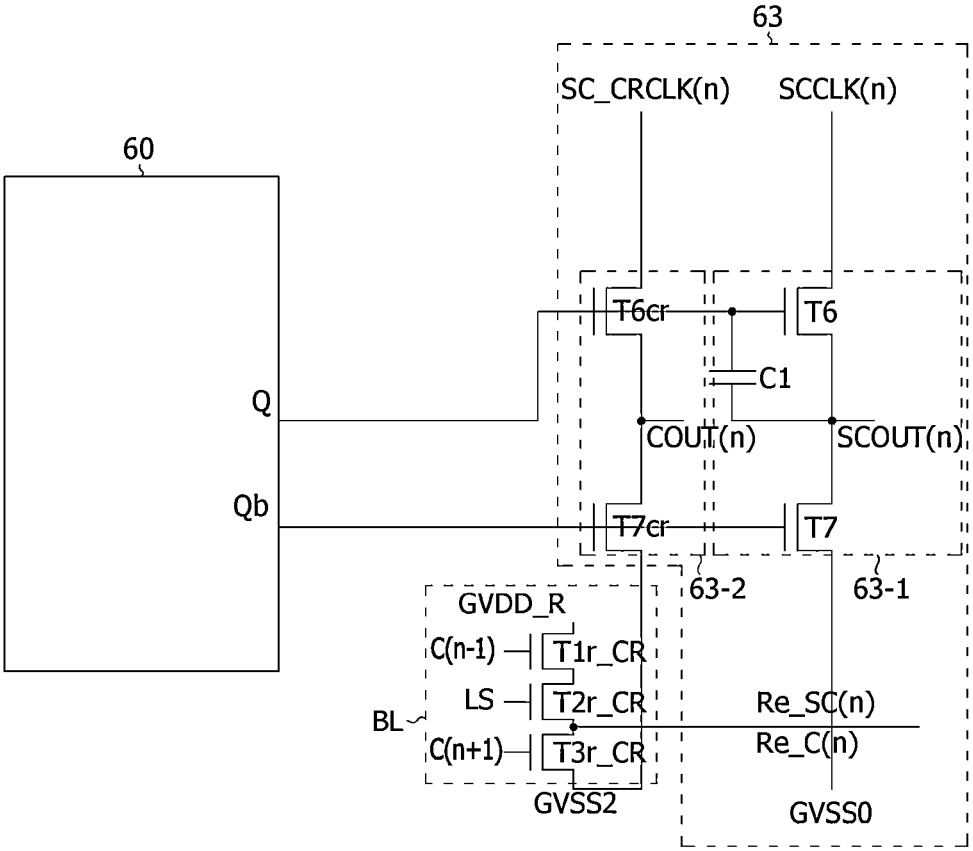
FIG. 11 is a view illustrating a gate driving circuit according to a third embodiment of the present disclosure.

FIG. 11 is a view illustrating a gate driving circuit according to a third embodiment of the present disclosure.

Referring to FIG. 11, the scan driving circuit according to the third embodiment may include a first control node (hereinafter, referred to as a "Q node") for pulling up an output voltage, a second control node (hereinafter, referred to as a "Qb node") for pulling down the output voltage, a circuit part 60, an output part 63, and a repair block BL in one embodiment.

The circuit part 60 serves to control charging and discharging of the Q node Q and the Qb node Qb in one embodiment.

The output part 63 may include a first output part 63-1 and a second output part 63-2 in one embodiment.

The first output part 63-1 may output a scan signal SCOUT(n) to a first output node on the basis of potentials of the first control node Q and the second control node Qb. The first output part 63-1 may include a first pull-up transistor T6 and a first pull-down transistor T7 in one embodiment.

The first pull-up transistor T6 and the first pull-down transistor T7 charge and discharge the first output node according to voltages of the first control node and the second control node to output the scan signal SCOUT(n). The first pull-up transistor T6 includes a gate electrode connected to the first control node Q, a first electrode to which a first clock signal is applied, and a second electrode connected to the first output node. The first pull-down transistor T7 is connected to the first pull-up transistor T6 with the first output node therebetween. The first pull-down transistor T7 includes a gate electrode connected to the second control node Qb, a first electrode connected to the first output node, and a second electrode connected to a first low potential voltage line GVSS0.

The second output part 63-2 may output a carry signal COUT(n) to a second output node on the basis of the potentials of the first control node Q and the second control node Qb in one embodiment. The second output part 63-2 may include a second pull-up transistor T6*cr* and a second pull-down transistor T7*cr* in one embodiment.

The second pull-up transistor T6*cr* and the second pull-down transistor T7*cr* charge and discharge the second output node according to the voltages of the first control node and the second control node to output the carry signal COUT(n). The second pull-up transistor T6*cr* includes a gate electrode connected to the first control node Q, a first electrode to which a second clock signal is applied, and a second electrode connected to the second output node. The second pull-down transistor T7*cr* is connected to the second pull-up transistor T6*cr* with the second output node therebetween. The second pull-down transistor T7*cr* includes a gate electrode connected to the second control node Qb, a first electrode connected to the second output node, and a second electrode connected to a second low potential voltage line GVSS2.

The repair block BL does not operate when the scan signal and the carry signal are normally output respectively through the first output part 63-1 and the second output part 63-2 and operate only when the scan signal and the carry signal are not normally output.

The repair block BL may be a block for repairing the first output part 63-1 and the second output part 63-2, and may replace defective first output part 63-1 and second output part 63-2 to output a repair scan signal Re_SC(n) and a repair carry signal Re_C(n) to the repair output node in one embodiment. Here, the repair scan signal Re_SC(n) and the repair carry signal Re_C(n) may be the same signal. The repair block BL may include a first repair transistor T1*r*_CR, a second repair transistor T2*r*_CR, and a third repair transistor T3*r*_CR. A repair output node to which the repair scan signal Re_SC(n) and the repair carry signal Re_C(n) are output is connected to both the first output node to which the scan signal is output and the second output node from which the carry signal is output.

The first repair transistor T1*r*_CR may be turned on by a carry signal C(n−1) from a previous signal transmitter, and may output a high potential voltage to the repair output node along with the second repair transistor T2*r*_CR. The first repair transistor T1*r*_CR includes a first electrode connected to a second high potential voltage line GVDD_R to which a second high potential voltage is applied, a gate electrode to which the carry signal C(n−1) from the previous signal transmitter is applied, and a second electrode connected to a first electrode of the second repair transistor T2*r*_CR.

The second repair transistor T2*r*_CR may be turned on by a logic signal from a timing controller TCON to output the second high potential voltage to the repair output node along with the first repair transistor T1*r*_CR. The second repair transistor T2*r*_CR includes the first electrode connected to the second electrode of the first repair transistor T1*r*_CR, a gate electrode to which the logic signal is applied, and a second electrode connected to the repair output node.

The third repair transistor T3*r*_CR may be turned on by a carry signal C(n+1) from a next signal transmitter to output the second low potential voltage to the repair output node. The third repair transistor T3*r*_CR includes a first electrode connected to the repair output node, a gate electrode to which the carry signal C(n+1) from the next signal transmitter is applied, and a second electrode connected to the second low potential voltage line GVSS2 to which the second low potential voltage is applied.

Figure 12:
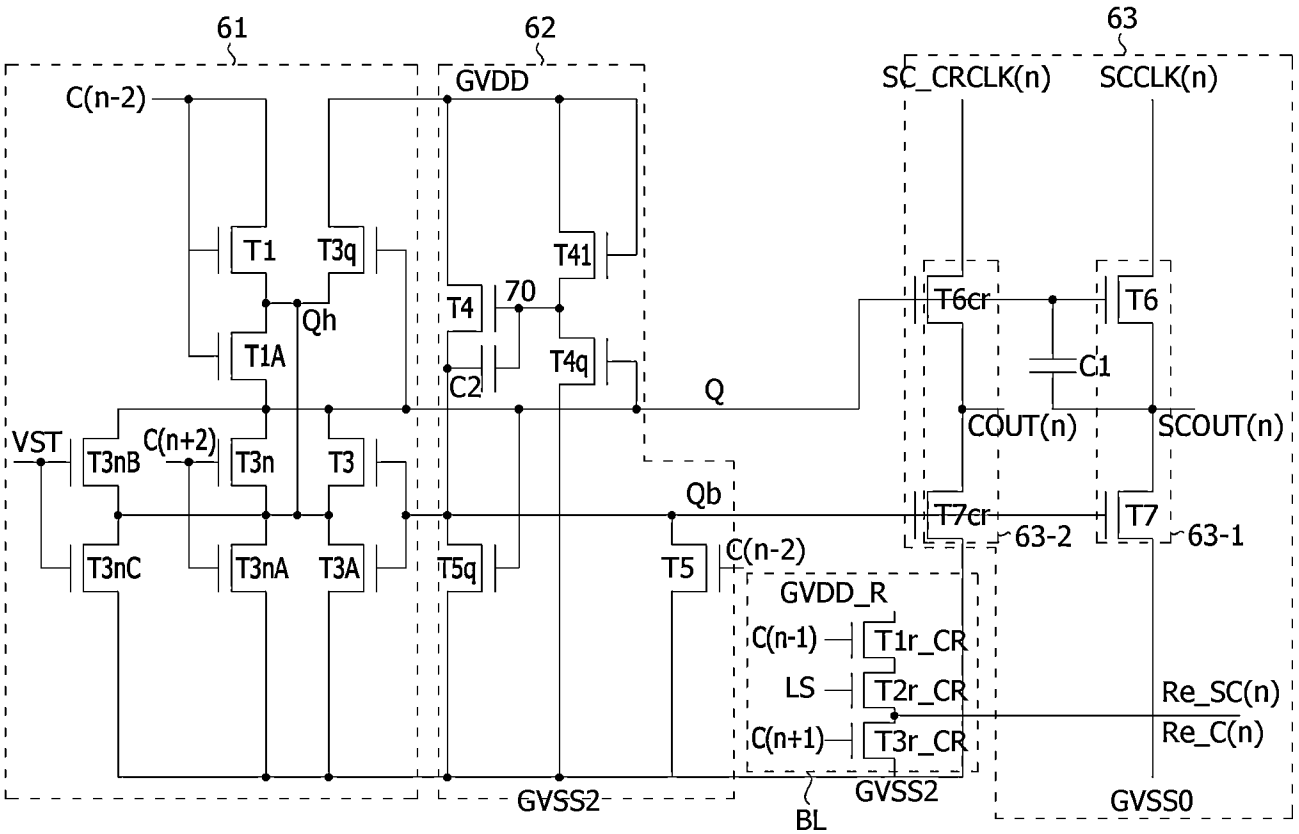
FIG. 12 is a view illustrating a gate driving circuit according to a fourth embodiment of the present disclosure.

FIG. 12 is a view illustrating a gate driving circuit according to a fourth embodiment of the present disclosure. Here, an example in which the gate driving circuit is implemented as a scan driving circuit will be described.

Referring to FIG. 12, the scan driving circuit according to the fourth embodiment may include a first control node (hereinafter, referred to as a "Q node") for pulling up an output voltage, a second control node (hereinafter, referred to as a "Qb node") for pulling down the output voltage, a first circuit part 61, a second circuit part 62, an output part 63, and a repair block BL in one embodiment.

The first circuit part 61 serves to control charging and discharging of the Q node Q and the Qb node Qb in one embodiment. The first circuit part 61 includes a first transistor T1, a 1A-th transistor T1A, a third transistor T3, a 3A-th transistor T3A, a 3n-th transistor T3*n*, a 3 nA-th transistor T3*n*A, a 3q-th transistor T3*q*, a 3nB-th transistor T3*n*B, and a 3nC-th transistor T3*n*C in one embodiment.

The first transistor T1 is turned on by an (n−2)th carry signal C(n−2) applied through an (n−2)th carry signal line and transfers the (n−2)th carry signal to a Qh node Qh. The first transistor T1 has a gate electrode and a first electrode commonly connected to the (n−2)th carry signal line, and a second electrode connected to the Qh node Qh.

The 1A-th transistor T1A is turned on by the (n−2)th carry signal C(n−2) applied through the (n−2)th carry signal line and charges the Q node Q on the basis of the (n−2)th carry signal. The 1A-th transistor T1A has a gate electrode connected to the (n−2)th carry signal line, a first electrode connected to the second electrode of the first transistor T1, and a second electrode connected to the Q node Q.

The third transistor T3 is turned on by the voltage of the Qb node Qb and discharges the Q node Q to a second low potential voltage of a second low potential voltage line GVSS2 along with the 3A-th transistor T3A. The third transistor T3 has a gate electrode connected to the Qb node Qb, a first electrode connected to the Q node Q, and a second electrode connected to a first electrode of the 3A-th transistor T3A.

The 3A-th transistor T3A is turned on by the voltage of the Qb node Qb and discharges the Q node Q to the second low potential voltage of the second low potential voltage line GVSS2 along with the third transistor T3. The 3A-th transistor T3A has a gate electrode connected to the Qb node Qb, the first electrode connected to the second electrode of the third transistor T3, and a second electrode connected to the second low potential voltage line GVSS2.

The 3n-th transistor T3*n* is turned on by an (n+2)th carry signal C(n+2) applied through an (n+2)th carry signal line and discharges the Q node Q to the second low potential voltage of the second low potential voltage line GVSS2 along with the 3 nA-th transistor T3*n*A. The 3n-th transistor T3*n* has a gate electrode connected to the (n+2)th carry signal line, a first electrode connected to the Q node Q, and a second electrode connected to a first electrode of the 3 nA-th transistor T3*n*A.

The 3 nA-th transistor T3*n*A is turned on by the (n+2)th carry signal C(n+2) applied through the (n+2)th carry signal line and discharges the Q node Q to the second low potential voltage of the second low potential voltage line GVSS2 along with the 3n-th transistor T3*n*. The 3 nA-th transistor T3*n*A has a gate electrode connected to the (n+2)th carry signal line, the first electrode connected to the second electrode of the 3n-th transistor T3*n*, and a second electrode connected to the second low potential voltage line GVSS2.

The 3q-th transistor T3*q* is turned on by the voltage of the Q node Q and transfers a high potential voltage of a high potential voltage line GVDD to the Qh node Qh. The 3q-th transistor T3*q* has a gate electrode connected to the Q node Q, a first electrode connected to the high potential voltage line GVDD, and a second electrode connected to the Qh node Qh.

The 3nB-th transistor T3*n*B is turned on by a start pulse VST and discharges the first control node Q to a second low potential voltage of a second low potential voltage line GVSS2 along with the 3nC-th transistor T3*n*C. The 3nB-th transistor T3*n*B has a first electrode connected to the first control node Q, a gate electrode to which the start pulse VST is applied, and a second electrode connected to the first electrode of the 3A-th transistor T3A.

The 3nC-th transistor T3*n*C is turned on by the start pulse VST and discharges the first control node Q to a second low potential voltage of a second low potential voltage line GVSS2 along with the 3nB-th transistor T3*n*B. The 3nC-th transistor T3*n*C has a first electrode connected to the second electrode of the 3nB-th transistor T3*n*B, a gate electrode to which the start pulse VST is applied, and a second electrode connected to the second low potential voltage line GVSS2.

The second circuit part 62 includes a fourth transistor T4, a 41-st transistor T41, a 4q-th transistor T4*q*, a fifth transistor T5, and a 5q-th transistor T5*q* in one embodiment.

The fourth transistor T4 is turned on by a voltage of a first node 70 and supplies a high potential voltage to the second control node. The fourth transistor T4 includes a first electrode connected to the high potential voltage line to which the high potential voltage is applied, a gate electrode connected to the first node 70, and a second electrode connected to the second control node. A second capacitor C2 serves to form a bootstrapping voltage at a gate node of the fourth transistor T4.

The 41-st transistor T41 is turned on by the high potential voltage and supplies the high potential voltage to the first node 70. The 41-st transistor T41 includes a first electrode and a gate electrode, which are connected to the high potential voltage line, and a second electrode connected to the first node 70.

The 4q-th transistor T4*q* is turned on by the voltage of the first control node and discharges the first node 70 to the second low potential voltage. The 4q-th transistor T4*q* includes a first electrode connected to the first node 70, a gate electrode connected to the first control node, and a second electrode connected to the second low potential voltage line.

The 5q-th transistor T5*q* is turned on by the voltage of the first control node and discharges the second control node to the second low potential voltage. The 5q-th transistor T5*q* includes a first electrode connected to the second control node, a gate electrode connected to the first control node, and a second electrode connected to the second low potential voltage line GVSS2.

The fifth transistor T5 is turned on by the voltage of a carry signal C(n−2) from a previous signal transmitter and discharges the second control node to the second low potential voltage. The fifth transistor T5 includes a first electrode connected to the second control node, a gate electrode to which the carry signal is applied from the previous signal transmitter, and a second electrode connected to the second low potential voltage line GVSS2.

The output part 63 may include a first output part 63-1 and a second output part 63-2 in one embodiment.

The first output part 63-1 may output a scan signal SCOUT(n) to a first output node on the basis of potentials of the first control node Q and the second control node Qb. The first output part 63-1 may include a first pull-up transistor T6 and a first pull-down transistor T7.

The first pull-up transistor T6 and the first pull-down transistor T7 charge and discharge the first output node according to voltages of the first control node and the second control node to output the scan signal SCOUT(n). The first pull-up transistor T6 includes a gate electrode connected to the first control node Q, a first electrode to which a first clock signal is applied, and a second electrode connected to the first output node. The first pull-down transistor T7 is connected to the first pull-up transistor T6 with the first output node therebetween. The first pull-down transistor T7 includes a gate electrode connected to the second control node Qb, a first electrode connected to the first output node, and a second electrode connected to a first low potential voltage line GVSS0. A first capacitor C1 serves to form a bootstrapping voltage at a gate node of the first pull-up transistor T6.

The second output part 63-2 may output a carry signal COUT(n) to a second output node on the basis of the potentials of the first control node Q and the second control node Qb. The second output part 63-2 may include a second pull-up transistor T6*cr* and a second pull-down transistor T7*cr*.

The second pull-up transistor T6*cr* and the second pull-down transistor T7*cr* charge and discharge the second output node according to the voltages of the first control node and the second control node to output the carry signal COUT(n). The second pull-up transistor T6*cr* includes a gate electrode connected to the first control node Q, a first electrode to which a second clock signal is applied, and a second electrode connected to the second output node. The second pull-down transistor T7*cr* is connected to the second pull-up transistor T6*cr* with the second output node therebetween. The second pull-down transistor T7*cr* includes a gate electrode connected to the second control node Qb, a first electrode connected to the second output node, and a second electrode connected to the second low potential voltage line GVSS2.

The repair block BL may be a block for repairing the first output part 63-1 and the second output part 63-2, and may replace defective first output part 63-1 and second output part 63-2 to output a repair scan signal Re_SC(n) and a repair carry signal Re_C(n) to the repair output node in one embodiment. Here, the repair scan signal Re_SC(n) and the repair carry signal Re_C(n) may be the same signal. The repair block BL may include a first repair transistor T1*r*_CR, a second repair transistor T2*r*_CR, and a third repair transistor T3*r*_CR. A repair output node to which the repair scan signal Re_SC(n) and the repair carry signal Re_C(n) are output is connected to both the first output node to which the scan signal is output and the second output node to which the carry signal is output.

The first repair transistor T1*r*_CR may be turned on by a carry signal C(n−1) from a previous signal transmitter, and may output a high potential voltage to the repair output node along with the second repair transistor T2*r*_CR. The first repair transistor T1*r*_CR includes a first electrode connected to a second high potential voltage line GVDD_R to which a second high potential voltage is applied, a gate electrode to which the carry signal C(n−1) from the previous signal transmitter is applied, and a second electrode connected to a first electrode of the second repair transistor T2*r*_CR.

The second repair transistor T2*r*_CR may be turned on by a logic signal from a timing controller TCON to output the second high potential voltage to the repair output node along with the first repair transistor T1*r*_CR. The second repair transistor T2*r*_CR includes the first electrode connected to the second electrode of the first repair transistor T1*r*_CR, a gate electrode to which the logic signal is applied, and a second electrode connected to the repair output node.

The third repair transistor T3*r*_CR may be turned on by a carry signal C(n+1) from a next signal transmitter to output the second low potential voltage to the repair output node. The third repair transistor T3*r*_CR includes a first electrode connected to the repair output node, a gate electrode to which the carry signal C(n+1) from the next signal transmitter is applied, and a second electrode connected to the second low potential voltage line GVSS2 to which the second low potential voltage is applied.

Figure 13:
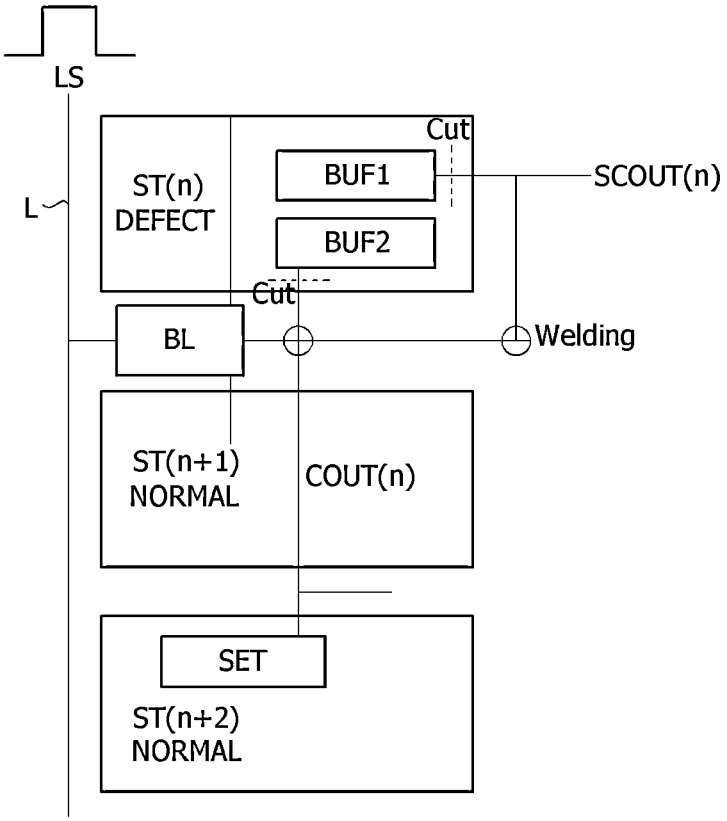
FIG. 13 is a view for describing a principle of repairing the gate driving circuit according to the fourth embodiment of the present disclosure.
Figure 14:
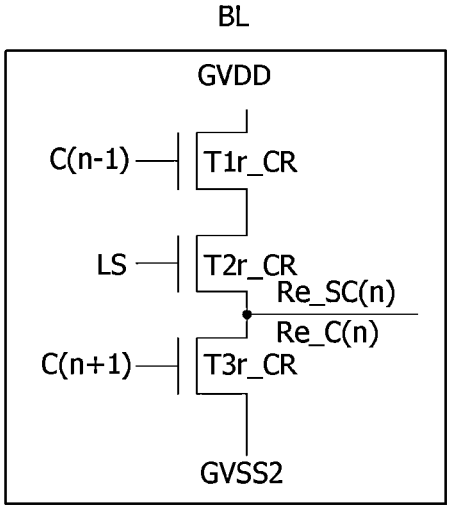
FIG. 14 is a view for describing an operation timing of a repair block illustrated in FIG. 13 according to the fourth embodiment of the present disclosure.
Figure 14:
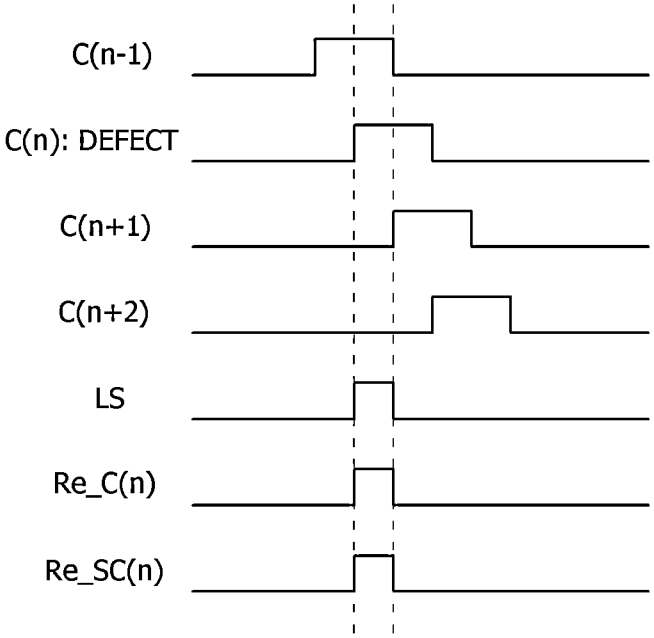

FIG. 13 is a view for describing a principle of repairing the gate driving circuit according to the fourth embodiment of the present disclosure, and FIG. 14 is a view for describing an operation timing of the repair block illustrated in FIG. 13 according to the fourth embodiment of the present disclosure.

Referring to FIG. 13, the gate driving circuit according to the fourth embodiment may include a plurality of signal transmitters ST(n), ST(n+1), and ST(n+2), which are cascade-connected, the repair block BL, and a repair line L.

When a defect occurs in the signal transmitter ST(n), a first output node to which the scan signal SCOUT(n) is output and a second output node to which the carry signal COUT(n) is output may be cut by a laser beam and electrically separated from first and second output parts BUF1 and BUF2 of the signal transmitter ST(n), and may be welded by the laser beam to be electrically connected to the repair block BL.

When the logic signal is applied from the timing controller through the repair line L, the repair block BL may output the repair scan signal Re_SC(n) to the first output node and output the repair carry signal Re_C(n) to the second output node.

Referring to FIGS. 12 and 14, when the carry signal is not generated from the signal transmitter ST(n) and thus a defect occurs, the logic signal LS and an (n−1)th carry signal C(n−1) may be simultaneously applied to generate the repair scan signal Re_SC(n) and the repair carry signal Re_C(n) as the same signal.

Figure 15:
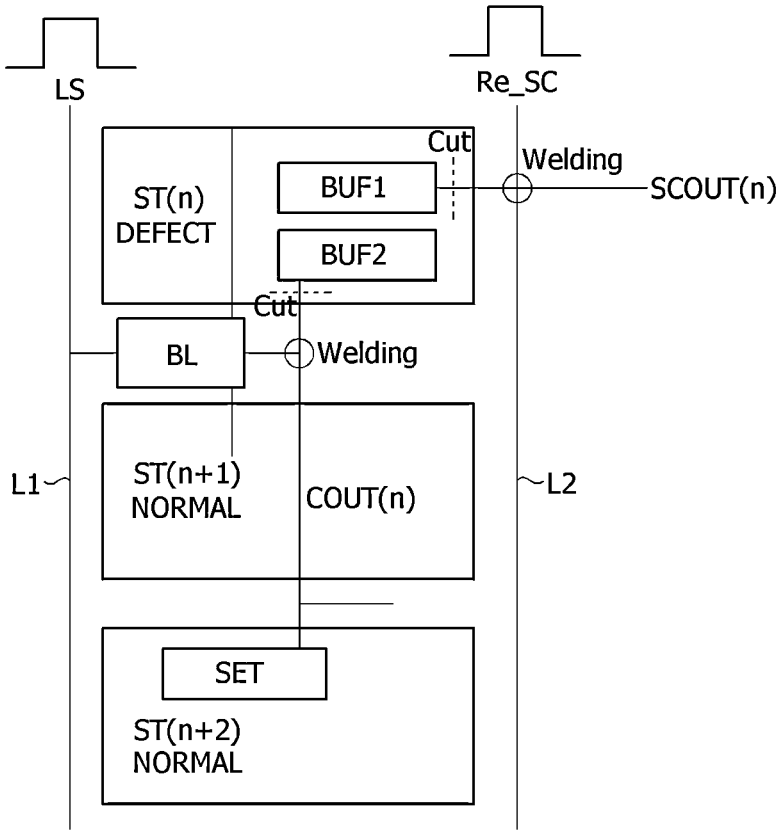
FIG. 15 is a view for describing another principle of repairing the gate driving circuit according to the fourth embodiment of the present disclosure.
Figure 16:
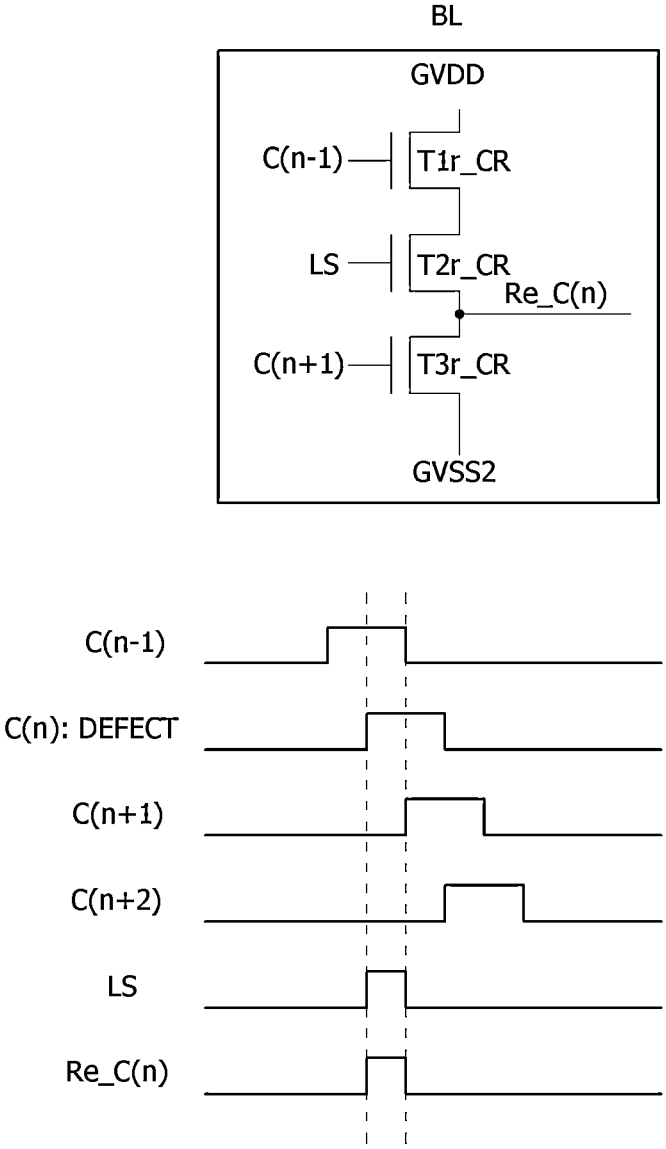
FIG. 16 is a view for describing an operation timing of a repair block illustrated in FIG. 15 according to the fourth embodiment of the present disclosure.

FIG. 15 is a view for describing another principle of repairing the gate driving circuit according to the fourth embodiment of the present disclosure, and FIG. 16 is a view for describing an operation timing of the repair block illustrated in FIG. 15 according to the fourth embodiment of the present disclosure.

Referring to FIG. 15, another gate driving circuit according to the fourth embodiment may include a plurality of signal transmitters ST(n), ST(n+1), and ST(n+2), which are cascade-connected, a repair block BL, a first repair line L1, and a second repair line L2.

When a defect occurs in the signal transmitter ST(n), a first output node to which the scan signal SCOUT(n) is output may be cut by a laser beam and electrically separated from a first output part BUF1 of the signal transmitter ST(n), and may be welded by the laser beam to be electrically connected to the second repair line L2.

A second output node to which the carry signal COUT(n) is output may be cut by the laser beam and electrically separated from a second output part BUF2 of the signal transmitter ST(n), and may be welded by the laser beam to be electrically connected to the repair block BL.

When a logic signal is applied from a timing controller through the first repair line L1, the repair block BL may output a repair carry signal Re_C(n) to the second output node.

A repair scan signal Re_SC(n), which is applied from a timing controller through the second repair line L2, may be output to the first output node.

Referring to FIGS. 12 and 16, when the carry signal C(n) is not generated from an n-th signal transmitter ST(n) and thus a defect occurs, the repair block BL may simultaneously apply the logic signal LS and the (n−1)th carry signal C(n−1) to generate the repair carry signal Re_C(n).

Figure 17:
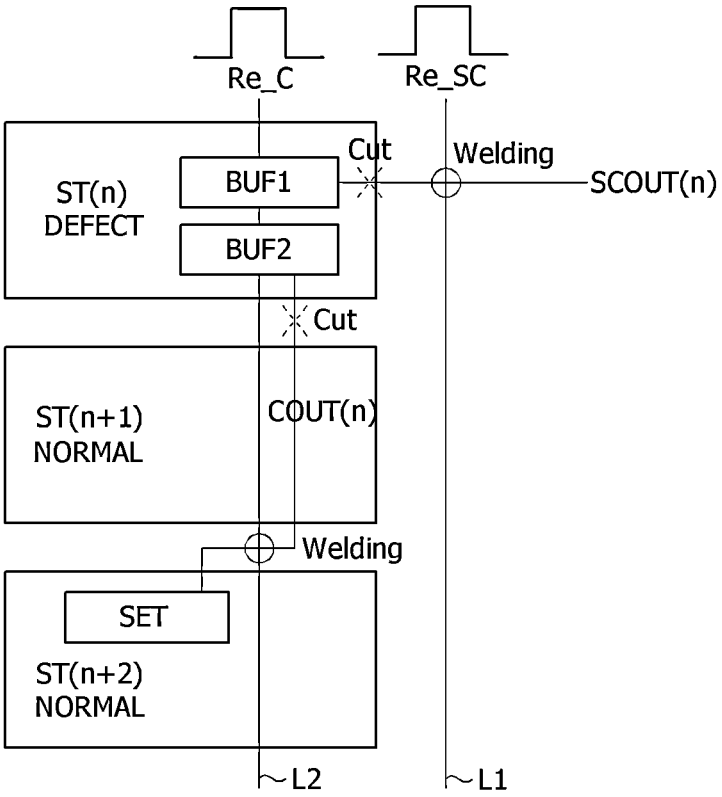
FIG. 17 is a view for describing a principle of repairing a gate driving circuit according to a fifth embodiment of the present disclosure.

FIG. 17 is a view for describing a principle of repairing a gate driving circuit according to a fifth embodiment of the present disclosure.

Referring to FIG. 17, the gate driving circuit according to the fifth embodiment of the present disclosure may include a plurality of signal transmitters, which are cascade-connected, a first repair line L1, and a second repair line L2.

In the embodiment, one side of a first output node connected to a first output part BUF1 of a signal transmitter ST(n), in which a defect occurs, may be cut by irradiating a laser beam, the other side of the first output node may be welded by the laser beam to be connected to the first repair line L1, and a repair scan signal Re_SC(n) applied through the first repair line L1 may be output to the first output node.

Similarly, one side of a second output node connected to a second output part BUF2 of the signal transmitter ST(n), in which the defect occurs, may be cut by the laser beam, the other side of the second output node may be welded by the laser beam to be connected to the second repair line L2, and a repair carry signal Re_C(n) applied through the second repair line L2 may be output to the second output node.

Figure 18A:
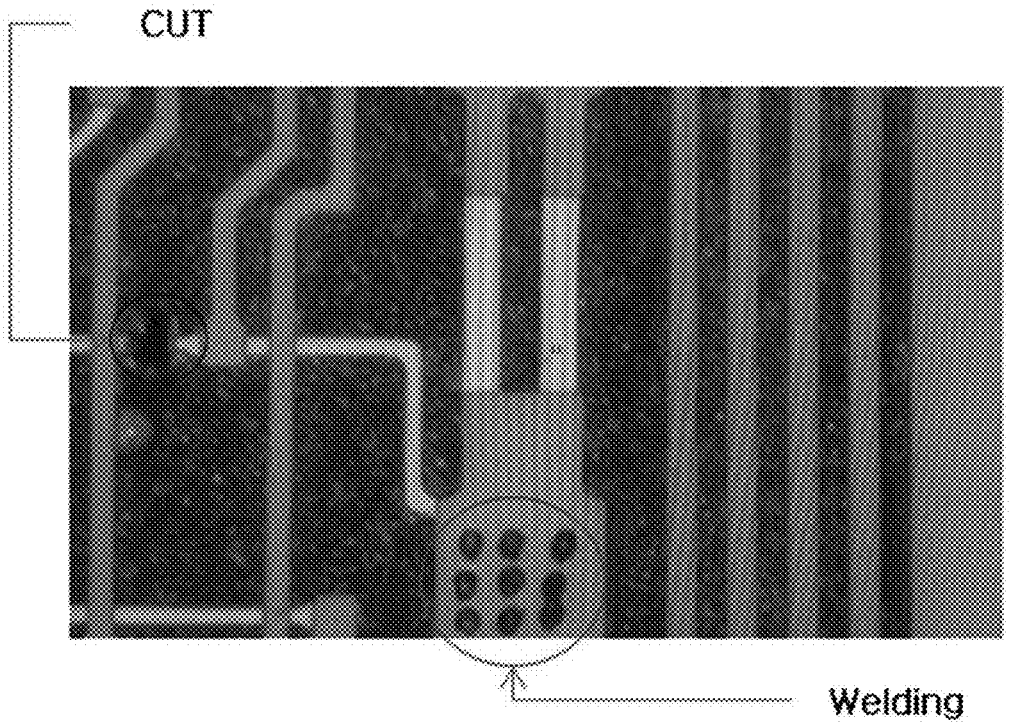
FIGS. 18A and 18B are images illustrating the results of repairing the gate driving circuit according to one embodiment.
Figure 18B:
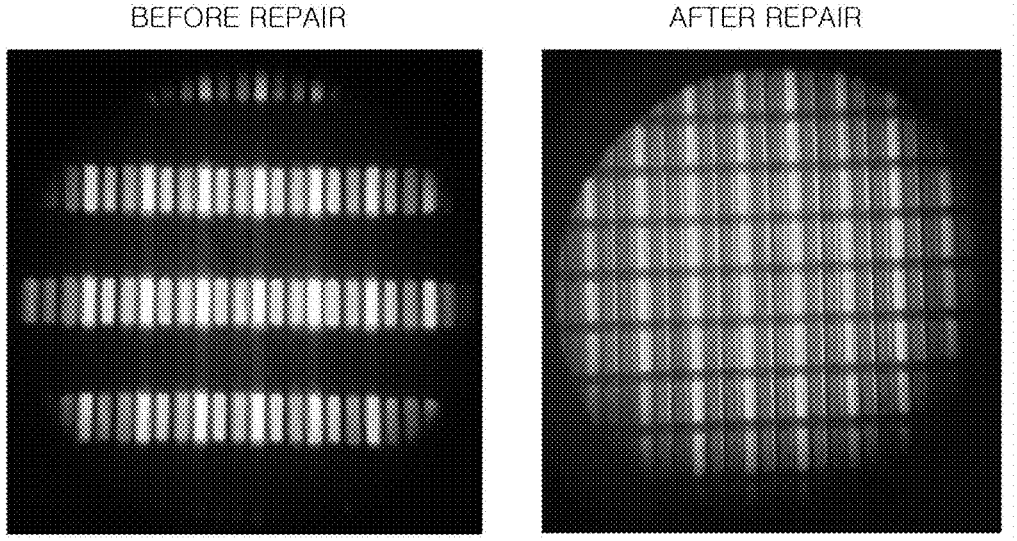

FIGS. 18A and 18B are images illustrating the results of actually repairing the gate driving circuit.

Referring to FIG. 18A, it is illustrated that one side of a line connected to the output node of the signal transmitter ST(n), in which a defect occurs, shown in FIG. 17 is cut by irradiating a laser beam, and the repair line is welded to the other side of the cut line by the laser beam.

Referring to FIG. 18B, it is illustrated that a line defect caused by a non-signal output state is resolved after being repaired by repair signals, that is, the repair scan signal and the repair carry signal, applied through the first repair line and the second repair line on behalf of the defective signal transmitter ST(n).

In the present disclosure, a repair block is provided for each signal transmitter, and when a defective signal transmitter is generated, a carry signal and a gate signal are output using a repair block, so that the defective signal transmitter can be easily repaired and a bezel size can be reduced. In particular, as a resolution is higher, or pixel per inch (PPI) is higher, the present disclosure can be advantageous in reducing a bezel size.

In the present disclosure, the number of welding points can be minimized so that a tact time in a process of making a good product can be reduced and a yield can be increased.

In the present disclosure, repair can be performed simply in the same manner regardless of the type of defect.

Although the embodiments of the present disclosure have been described in more detail with reference to the accompanying drawings, the present disclosure is not limited thereto and may be embodied in many different forms without departing from the technical concept of the present disclosure. Therefore, the embodiments disclosed in the present disclosure are provided for illustrative purposes only and are not intended to limit the technical concept of the present disclosure. The scope of the technical concept of the present disclosure is not limited thereto. Therefore, it should be understood that the above-described embodiments are illustrative in all aspects and do not limit the present disclosure. The protective scope of the present disclosure should be construed based on the following claims, and all the technical concepts in the equivalent scope thereof should be construed as falling within the scope of the present disclosure.

What is claimed is:

1. A gate driving circuit comprising:

a plurality of signal transmitters which are cascade-connected via a carry line to which a carry signal is applied to each signal transmitter from a previous signal transmitter from the plurality of signal transmitters; and a repair line connected to the plurality of signal transmitters, wherein an n-th signal transmitter from the plurality of signal transmitters includes:

a circuit configured to receive the carry signal from the previous signal transmitter, and charge or discharge a first control node and a second control node;

an output circuit configured to output a gate signal and a carry signal based on potentials of the first control node and the second control node; and a repair circuit connected to the repair line, the repair circuit configured to output a repair gate signal that replaces the gate signal output by the output circuit and a repair carry signal that replaces the carry signal output by the output circuit when a logic signal is applied from the repair line, wherein n is a positive integer.

2. The gate driving circuit of claim 1, wherein the repair circuit includes a first repair circuit configured to output the repair gate signal, wherein the first repair circuit includes a (1-1)th repair transistor, a (1-2)th repair transistor, and a (1-3)th repair transistor, wherein the (1-1)th repair transistor includes a first electrode of the (1-1)th repair transistor that is connected to a first high potential voltage line to which a first high potential voltage is applied, a gate electrode of the (1-1)th repair transistor to which a carry signal from an (n−1)th signal transmitter is applied, and a second electrode of the (1-1)th repair transistor that is connected to a first electrode of the (1-2)th repair transistor, the (1-2)th repair transistor includes the first electrode of the (1-2)th repair transistor that is connected to the second electrode of the (1-1)th repair transistor, a gate electrode of the (1-2)th repair transistor to which the logic signal is applied, and a second electrode of the (1-2)th repair transistor that is connected to a first repair output node, and the (1-3)th repair transistor includes a first electrode of the (1-3)th repair transistor that is connected to the first repair output node, a gate electrode of the (1-3)th repair transistor to which a carry signal from an (n+1)th signal transmitter is applied, and a second electrode of the (1-3)th repair transistor that is connected to a low potential voltage line.

3. The gate driving circuit of claim 1, wherein the repair circuit includes a first repair circuit configured to output the repair gate signal, wherein the first repair circuit includes a (1-1)th repair transistor, a (1-2)th repair transistor, and a (1-3)th repair transistor, wherein the (1-1)th repair transistor includes a first electrode of the (1-1)th repair transistor that is connected to a first high potential voltage line to which a first high potential voltage is applied, a gate electrode of the (1-1)th repair transistor to which the repair carry signal is applied, and a second electrode of the (1-1)th repair transistor that is connected to a first electrode of the (1-2)th repair transistor, the (1-2)th repair transistor includes the first electrode of the (1-2)th repair transistor that is connected to the second electrode of the (1-1)th repair transistor, a gate electrode of the (1-2)th repair transistor to which the logic signal is applied, and a second electrode of the (1-2)th repair transistor that is connected to a first repair output node, and the (1-3)th repair transistor includes a first electrode of the (1-3)th repair transistor that is connected to the first repair output node, a gate electrode of the (1-3)th repair transistor to which a carry signal from an (n+1)th signal transmitter is applied, and a second electrode of the (1-3)th repair transistor that is connected to a low potential voltage line.

4. The gate driving circuit of claim 2, wherein the repair circuit includes a second repair circuit configured to output the repair carry signal, wherein the second repair circuit includes a (2-1)th repair transistor, a (2-2)th repair transistor, and a (2-3)th repair transistor, wherein the (2-1)th repair transistor includes a first electrode of the (2-1)th repair transistor that is connected to a second high potential voltage line to which a second high potential voltage is applied, a gate electrode of the (2-1)th repair transistor to which the carry signal from an (n−1)th signal transmitter is applied, and a second electrode of the (2-1)th repair transistor that is connected to a first electrode of the (2-2)th repair transistor, the (2-2)th repair transistor includes the first electrode of the (2-2)th repair transistor that is connected to the second electrode of the (2-1)th repair transistor, a gate electrode of the (2-2)th repair transistor to which the logic signal is applied, and a second electrode of the (2-2)th repair transistor that is connected to a second repair output node, and the (2-3)th repair transistor includes a first electrode of the (2-3)th repair transistor that is connected to the second repair output node, a gate electrode of the (2-3)th repair transistor to which the carry signal from the (n+1)th signal transmitter is applied, and a second electrode of the (2-3)th repair transistor that is connected to the low potential voltage line.

5. The gate driving circuit of claim 4, wherein when the logic signal is applied from the repair line, a first output node to which the gate signal output by the output circuit is output is electrically separated from the output circuit and is electrically connected to the first repair circuit, and a second output node to which the carry signal output by the output circuit is output is electrically separated from the output circuit and is electrically connected to the second repair circuit.

6. The gate driving circuit of claim 1, wherein the repair circuit includes a first repair transistor, a second repair transistor, and a third repair transistor, wherein the first repair transistor includes a first electrode of the first repair transistor that is connected to a high potential voltage line to which a high potential voltage is applied, a gate electrode of the first repair transistor to which a carry signal from an (n−1)th signal transmitter is applied, and a second electrode of the first repair transistor that is connected to a first electrode of the second repair transistor, the second repair transistor includes the first electrode of the second repair transistor that is connected to the second electrode of the first repair transistor, a gate electrode of the second repair transistor to which the logic signal is applied, and a second electrode of the second repair transistor that is connected to a repair output node, and the third repair transistor includes a first electrode of the third repair transistor that is connected to the repair output node, a gate electrode of the third repair transistor to which a carry signal from an (n+1)th signal transmitter is applied, and a second electrode of the third repair transistor that is connected to a low potential voltage line.

7. The gate driving circuit of claim 6, wherein when the logic signal is applied from the repair line, a first output node to which the gate signal output by the output circuit is output is electrically separated from the output circuit and is electrically connected to the repair circuit, and a second output node to which the carry signal output by the output circuit is output is electrically separated from the output circuit and is electrically connected to the repair circuit.

8. A gate driving circuit comprising:

a plurality of signal transmitters which are cascade-connected via a carry line to which a carry signal is applied to each signal transmitter from a previous signal transmitter from the plurality of signal transmitters; and a first repair line and a second repair line connected to the plurality of signal transmitters, wherein an n-th signal transmitter from the plurality of signal transmitters includes:

a circuit configured to receive the carry signal from the previous signal transmitter, and charge or discharge a first control node and a second control node;

a first output circuit configured to output a gate signal to a first output node based on potentials of the first control node and the second control node;

a second output circuit configured to output a carry signal to a second output node based on the potentials of the first control node and the second control node; and a repair circuit connected to the first repair line, the repair circuit configured to output a repair carry signal that replaces the carry signal output by the second output circuit when a logic signal is applied from the first repair line, the second repair line is electrically connected to the first output node, and a repair gate signal that replaces the gate signal output by the first output circuit, which is applied to the second repair line, is output to the first output node at a same time when the logic signal is applied, wherein n is a positive integer.

9. The gate driving circuit of claim 8, wherein the repair circuit includes a first repair transistor, a second repair transistor, and a third repair transistor, wherein the first repair transistor includes a first electrode of the first repair transistor that is connected to a high potential voltage line to which a high potential voltage is applied, a gate electrode of the first repair transistor to which a carry signal from an (n−1)th signal transmitter is applied, and a second electrode of the first repair transistor that is connected to a first electrode of the second repair transistor, the second repair transistor includes the first electrode of the second repair transistor that is connected to the second electrode of the first repair transistor, a gate electrode of the second repair transistor to which the logic signal is applied, and a second electrode of the second repair transistor that is connected to a repair output node, and the third repair transistor includes a first electrode of the third repair transistor that is connected to the repair output node, a gate electrode of the third repair transistor to which a carry signal from an (n+1)th signal transmitter is applied, and a second electrode of the third repair transistor that is connected to a low potential voltage line.

10. A display device comprising:

a display panel including a plurality of data lines, a plurality of gate lines that intersect the plurality of data lines, a plurality of power lines to which different constant voltages are applied, and a plurality of sub-pixels;

a data driving circuit configured to supply a data voltage of pixel data to the plurality of data lines; and a gate driving circuit configured to supply a gate signal to the plurality of gate lines, wherein the gate driving circuit includes:

a plurality of signal transmitters which are cascade-connected via a carry line to which a carry signal is applied to each signal transmitter from a previous signal transmitter from the plurality of signal transmitters; and a repair line connected to the plurality of signal transmitters, wherein an n-th signal transmitter from the plurality of signal transmitters includes:

a circuit configured to receive the carry signal from the previous signal transmitter, and charge or discharge a first control node and a second control node;

an output circuit configured to output a gate signal and a carry signal based on potentials of the first control node and the second control node; and a repair circuit connected to the repair line, the repair circuit configured to output a repair gate signal that replaces the gate signal output by the output circuit and a repair carry signal that replaces the carry signal output by the output circuit when a logic signal is applied from the repair line, wherein n is a positive integer.

11. The display device of claim 10, wherein the repair circuit includes a first repair circuit configured to output the repair gate signal, wherein the first repair circuit includes a (1-1)th repair transistor, a (1-2)th repair transistor, and a (1-3)th repair transistor, wherein the (1-1)th repair transistor includes a first electrode of the (1-1)th repair transistor that is connected to a first high potential voltage line to which a first high potential voltage is applied, a gate electrode of the (1-1)th repair transistor to which a carry signal from an (n−1)th signal transmitter is applied, and a second electrode of the (1-1)th repair transistor that is connected to a first electrode of the (1-2)th repair transistor, the (1-2)th repair transistor includes the first electrode of the (1-2)th repair transistor that is connected to the second electrode of the (1-1)th repair transistor, a gate electrode of the (1-2)th repair transistor to which the logic signal is applied, and a second electrode of the (1-2)th repair transistor that is connected to a first repair output node, and the (1-3)th repair transistor includes a first electrode of the (1-3)th repair transistor that is connected to the first repair output node, a gate electrode of the (1-3)th repair transistor to which a carry signal from an (n+1)th signal transmitter is applied, and a second electrode of the (1-3)th repair transistor that is connected to a low potential voltage line.

12. The display device of claim 10, wherein the repair circuit includes a first repair circuit configured to output the repair gate signal, wherein the first repair circuit includes a (1-1)th repair transistor, a (1-2)th repair transistor, and a (1-3)th repair transistor, wherein the (1-1)th repair transistor includes a first electrode of the (1-1)th repair transistor that is connected to a first high potential voltage line to which a first high potential voltage is applied, a gate electrode of the (1-1)th repair transistor to which the repair carry signal is applied, and a second electrode of the (1-1)th repair transistor that is connected to a first electrode of the (1-2)th repair transistor, the (1-2)th repair transistor includes the first electrode of the (1-2)th repair transistor that is connected to the second electrode of the (1-1)th repair transistor, a gate electrode of the (1-2)th repair transistor to which the logic signal is applied, and a second electrode of the (1-2)th repair transistor that is connected to a first repair output node, and the (1-3)th repair transistor includes a first electrode of the (1-3)th repair transistor that is connected to the first repair output node, a gate electrode of the (1-3)th repair transistor to which a carry signal from an (n+1)th signal transmitter is applied, and a second electrode of the (1-3)th repair transistor that is connected to a low potential voltage line.

13. The display device of claim 11, wherein the repair circuit includes a second repair circuit configured to output the repair carry signal, wherein the second repair circuit includes a (2-1)th repair transistor, a (2-2)th repair transistor, and a (2-3)th repair transistor, wherein the (2-1)th repair transistor includes a first electrode of the (2-1)th repair transistor that is connected to a second high potential voltage line to which a second high potential voltage is applied, a gate electrode of the (2-1)th repair transistor to which the carry signal from an (n−1)th signal transmitter is applied, and a second electrode of the (2-1)th repair transistor that is connected to a first electrode of the (2-2)th repair transistor, the (2-2)th repair transistor includes the first electrode of the (2-2)th repair transistor that is connected to the second electrode of the (2-1)th repair transistor, a gate electrode of the (2-2)th repair transistor to which the logic signal is applied, and a second electrode of the (2-2)th repair transistor that is connected to a second repair output node, and the (2-3)th repair transistor includes a first electrode of the (2-3)th repair transistor that is connected to the second repair output node, a gate electrode of the (2-3)th repair transistor to which the carry signal from the (n+1)th signal transmitter is applied, and a second electrode of the (2-3)th repair transistor that is connected to the low potential voltage line.

14. The display device of claim 10, wherein the repair circuit includes a first repair transistor, a second repair transistor, and a third repair transistor, wherein the first repair transistor includes a first electrode of the first repair transistor that is connected to a high potential voltage line to which a high potential voltage is applied, a gate electrode of the first repair transistor to which a carry signal from an (n−1)th signal transmitter is applied, and a second electrode of the first repair transistor that is connected to a first electrode of the second repair transistor, the second repair transistor includes the first electrode of the second repair transistor that is connected to the second electrode of the first repair transistor, a gate electrode of the second repair transistor to which the logic signal is applied, and a second electrode of the second repair transistor that is connected to a repair output node, and the third repair transistor includes a first electrode of the third repair transistor that is connected to the repair output node, a gate electrode of the third repair transistor to which a carry signal from an (n+1)th signal transmitter is applied, and a second electrode of the third repair transistor that is connected to a low potential voltage line.

15. The display device of claim 10, wherein all transistors in the data driver, the gate driver, and the sub-pixels are implemented with oxide thin film transistors including an n-channel type oxide semiconductor.

16. A display device comprising:

a display panel including a plurality of data lines, a plurality of gate lines that intersect the plurality of data lines, a plurality of power lines to which different constant voltages are applied, and a plurality of sub-pixels;

a data driving circuit configured to supply a data voltage of pixel data to the plurality of data lines; and a gate driving circuit configured to supply a gate signal to the plurality of gate lines, wherein the gate driving circuit includes:

a plurality of signal transmitters which are cascade-connected via a carry line to which a carry signal is applied to each signal transmitter from a previous signal transmitter from the plurality of signal transmitters; and a first repair line and a second repair line connected to the plurality of signal transmitters, wherein an n-th signal transmitter from the plurality of signal transmitters includes:

a circuit configured to receive the carry signal from the previous signal transmitter, and charge or discharge a first control node and a second control node;

a first output circuit configured to output a gate signal to a first output node based on potentials of the first control node and the second control node;

a second output circuit configured to output a carry signal to a second output node based on the potentials of the first control node and the second control node; and a repair circuit connected to the first repair line, the repair circuit configured to output a repair carry signal replacing the carry signal output by the second output circuit when a logic signal is applied from the first repair line, the second repair line is electrically connected to the first output node, and a repair gate signal that replaces the gate signal output by the first output circuit, which is applied to the second repair line, is output to the first output node at a same time when the logic signal is applied, wherein n is a positive integer.

17. The display device of claim 16, wherein the repair circuit includes a first repair transistor, a second repair transistor, and a third repair transistor, wherein the first repair transistor includes a first electrode of the first repair transistor that is connected to a high potential voltage line to which a high potential voltage is applied, a gate electrode of the first repair transistor to which a carry signal from an (n−1)th signal transmitter is applied, and a second electrode of the first repair transistor that is connected to a first electrode of the second repair transistor, the second repair transistor includes the first electrode of the second repair transistor that is connected to the second electrode of the first repair transistor, a gate electrode of the second repair transistor to which the logic signal is applied, and a second electrode of the second repair transistor that is connected to a repair output node, and the third repair transistor includes a first electrode of the third repair transistor that is connected to the repair output node, a gate electrode of the third repair transistor to which a carry signal from an (n+1)th signal transmitter is applied, and a second electrode of the third repair transistor that is connected to a low potential voltage line.

18. The display device of claim 16, wherein all transistors in the data driver, the gate driver, and the sub-pixels are implemented with oxide thin film transistors including an n-channel type oxide semiconductor.

* * * * *